US005775528A

United States Patent [19]

Wohlgemuth et al.

[11] Patent Number: 5,775,528

[45] **Date of Patent: *Jul. 7, 1998**

[54] SNAP-ON/SCREW-OFF CAP AND NECK CONFIGURATION

[75] Inventors: Emanuel E. Wohlgemuth, North Bellmore, N.Y.; Charles Hogan, Spokane, Wash.

[73] Assignee: Superseal Corporation, Condado, Puerto Rico

[ * ] Notice: The portion of the term of this patent subsequent to Aug. 21, 2015, has been disclaimed.

[21] Appl. No.: 752,641

[22] Filed: Nov. 19, 1996

Related U.S. Application Data

[63] Continuation-in-part of Ser. No. 545,959, Oct. 20, 1995, which is a continuation-in-part of Ser. No. 517,065, Aug. 21, 1995, Pat. No. 5,642,825.

[51] Int. Cl.[6] ..... B65D 41/47

[52] U.S. Cl. ..... 215/256; 215/330; 215/901

[58] Field of Search ..... 215/256, 250, 215/254, 252, 330, 329, 901, 318, 44, 45, DIG. 1; 220/270, 276

[56] References Cited

U.S. PATENT DOCUMENTS

| | | | |
|---|---|---|---|
| 3,360,149 | 12/1967 | Roth | 215/45 X |
| 4,066,181 | 1/1978 | Robinson et al. | 215/256 |
| 4,103,803 | 8/1978 | Irvine | 215/256 X |
| 4,798,301 | 1/1989 | Bullock et al. | 215/256 |
| 4,798,303 | 1/1989 | Arnold | 215/329 |
| 4,922,684 | 5/1990 | Nelson . | |
| 5,431,291 | 7/1995 | LaBombarbe, Jr. | 215/44 |
| 5,553,727 | 9/1996 | Molinaro | 215/44 |
| 5,560,504 | 10/1996 | Molinaro | 215/256 |
| 5,642,825 | 7/1997 | Wohlgemuth | 215/330 X |

FOREIGN PATENT DOCUMENTS

| | | | |
|---|---|---|---|
| 1016084 | 10/1952 | France | 215/256 |
| 2517635 | 6/1983 | France | 215/329 |
| 681404 | 10/1952 | United Kingdom | 215/256 |

*Primary Examiner*—Allan N. Shoap
*Assistant Examiner*—Nathan Newhouse
*Attorney, Agent, or Firm*—Hoffmann & Baron, LLP

[57] ABSTRACT

A container closure system comprising a threaded cap and a threaded neck wherein the cap is affixed to the neck by direct axial application so that the mating threads slip past one another and into engagement. The cap further includes sealing means to capture and constrict the outer diameter of the neck, and valve means to plug the container opening in the neck and expand the outer diameter of the neck, so that the sealing means and valve means cooperate to improve sealing of the cap and neck. The cap and neck further include tamper-indication means to prevent removal of the cap without activation thereof. The tamper-indication means includes a novel skirt, pull tab and membrane configuration. The container neck may include interrupted threads which do not traverse the parting line and an additional annular seal below the threads on the container neck.

21 Claims, 25 Drawing Sheets

SNAP-ON/SCREW-OFF CAP AND NECK CONFIGURATION

RELATED APPLICATION

This application is a continuation-in-part of copending application Ser. No. 08/545,959 filed on Oct. 20, 1995, which is a continuation-in-part of copending application Ser. No. 08/517,065 filed on Aug. 21, 1995.

FIELD OF THE INVENTION

The present invention is related to caps and neck-finishes for use in blown plastic containers, specifically to caps and neck-finishes configured for snap-on assembly and screw-off disassembly.

BACKGROUND OF THE INVENTION

Blown plastic containers having mating threaded caps and neck-finishes are well known. Blow-molded plastic containers having mating annular features for snap-on assembly and snap-off disassembly are well known.

Threaded caps offer several advantages over snap-on caps in end use. Threaded caps are tightly sealable in spite of modest dimensional variations in the unpredictably blown neck. Threaded caps may be removed and re-assembled repeatedly with sealing consistency dependent only on the twisting force applied by the user. The sealing strength and reliability of threaded caps is generally superior to that of snap-on caps.

Snap-on caps, however, are more easily adapted for automatic assembly during the bottling process, primarily because relative rotational pre-positioning of the cap and neck is not required, and because only direct axial application of the cap onto the neck without rotation is required to affix the cap onto the neck during bottling. Such cap and neck configurations are therefor desirable in automated bottling applications.

Several attempts have been made in recent years to provide a cap which provides the advantages of both cap attachment methods, allowing direct axial application without rotational pre-positioning to affix the cap during bottling, and allowing the sealing reliability and end-use advantages of threaded engagement. British Patent specification BB 2,114,553 discloses a snap-on, screw-off cap and neck finish assembly. The inner wall of the cap is threaded, and includes multiple leads. A tamper ring is secured to the body portion of the cap by frangible bridges or webs. The inner surface of the tamper ring is interlocked with the container neck. The tamper ring will accordingly be separated from the cap body upon cap rotation, thereby providing indication that the container has been opened.

U.S. Pat. No. 5,190,178 also discloses a cap and neck-finish configuration which provides snap-on assembly, screw-off disassembly and re-assembly, and a tamper-indicating frangible lock ring. Buttress type threads comprised in the neck finish allow the threads of the cap to be axially forced thereover during bottling. Interlocking features comprising ratchet teeth on the frangible ring and on the neck-finish collar prevent rotation of the cap with respect to the collar. An orientation feature is disclosed. The orientation of a seven lead thread as disclosed will bring the cap closer to bottoming out leaving less chance for pre-turn after the cap has been axially displaced onto the neck and ensuring that the valve is deeply positioned in the bottle opening to provide a tight seal. Such a need for proper pre-alignment is a drawback to the disclosed configuration, as it represents an additional procedure during the bottling process.

Further, although the interlocking of the frangible ring and collar disclosed in U.S. Pat. No. 5,190,178 is intended to require removal of the ring for unscrewing of the cap, the non-continuous frangible engagement partially around the collar has proven in actual embodiment to allow rotational slippage during unscrewing without such frangible removal, thereby circumventing the intended tamper-indication.

In U.S. Pat. Nos. 5,285,912 and 5,307,946, cap and neck-finish configurations are disclosed which provide snap-on assembly, screw-off disassembly and re-assembly, and tamper-indicating frangible lock rings. In both patents mating seven lead threads in the cap and neck are disclosed. Both patents promise to provide ease of automatic assembly by allowing direct axial application without pre-alignment of the cap to the neck, to provide more reliable sealing, and to provide true tamper-indication. However, in actual embodiment, the configurations are found prone to leakage and tamper-indication failure due to the potential rotational misalignment of up to one-seventh of a rotation from optimal and due to insufficient sealing of the container opening to allow for the effects of such misalignment. The particular thread configuration disclosed and practiced is found to provide insufficient sealing forces in some relative rotational positions of the cap and neck, and the non-continuous frangible ring engagement partially around the collar is found to allow rotational slippage during unscrewing, thereby circumventing the intended tamper-indication.

The one way rotatable engagement of the frangible rings with the collars of these disclosures and embodiments is imperative, as dictated by the need to allow additional cap tightening after axial assembly on containers found to be leaking during bottling. This ratchet interface allows tightening but not loosening of the cap, and is practically blow-moldable only partially around the collar. The one way rotatable engagement offers an additional psychological drawback as well, in that end-users often notice that additional tightening is possible and believe that the particular cap was not fully tightened at bottling. Although these drawbacks have been well recognized in the bottling industry, no embodiment has yet been forthcoming which provides sealing reliable enough to obviate the need for the one-directional ratchet interlock and allow full circumferential interlocking. No embodiment has yet been forthcoming which maintains sealing integrity throughout the range of possible variations in the cap and container interface.

U.S. Pat. No. 4,922,684 discloses a screw-on, screw-off cap for milk bottles having four screw threads with serrations and a neck finish having mating threads also including serrations. The mating serrations prevent inadvertent relative rotation of the cap and bottle to prevent partial opening of the closure. Furthermore, the cap includes a tamper-evident ring having ratchet teeth which engage mating ratchet teeth on the neck finish to prevent removal of the cap from the bottle without separation of the tamper ring from the cap. The tamper ring includes a tab having a thin bridge connecting the free end of the tab, which traverses an opening in the ring, to an outer portion of the tamper ring. Breaking the bridge exposes the tab so that upon pulling the tab the tamper ring can be removed and the cap can be unscrewed.

As a result of the drawbacks of these prior art cap and neck configurations, the bottling industry today suffers from the lack of an easily attachable and leak-proof cap with true tamper-indication, at great loss and risk.

OBJECTS AND SUMMARY OF THE INVENTION

The present invention is a cap and neck-finish configuration for a blown container adapted to allow more reliable sealing after direct axial assembly without post-tightening, to obviate the need for one-way rotatability of the cap relative to the neck, and to provide positive tamper-indication. Both the cap and neck threads are of the modified Buttress type and opposingly directed to provide improved slip-over during snap-on assembly and improved sealing strength thereafter. The cap and neck each include an eight-lead thread to ensure that the relative rotational position of the cap and neck at the initiation of axial engagement cannot vary more than forty-five angular degrees from optimal final engagement. Both the cap and neck threads are of the same pitch to allow proper thread mating. The eight-lead thread of the cap improves screw-on assembly starting for the user, while improving cap to neck squareness for improved sealing. The cap interior includes an annular wiper which sealingly engages an unthreaded portion of the neck's exterior and a reverse-tapered annular wall depending within and sealingly engaging the neck's opening to provide a sealing value which cooperates with the wiper seal to capture the neck at both the neck's interior and exterior. The cap further comprises a frangible tamper-indicating ring with forty-five rotational locking lugs which interlock with mating opposing ratchet teeth in the neck's collar. The lug tips are tapered to direct the lugs in between the ratchet teeth and overcome slight misalignment during assembly, to ensure that the relative rotational position of the cap and neck at final engagement cannot be varied without activation of the tamper-indicator. This lug shape and the disposition of the lugs and teeth completely around the cap and collar facilitates proper interlocking regardless of the relative rotational positioning of the cap and neck. These interlock and thread arrangements provide that the axially assembled cap is not more than one forty-fifth of a revolution from maximum tightness, which is within a sealing range provided by the wiper/valve arrangement. This ensures that the dual interior/exterior sealing is fully engaged whether the cap is at maximum tightness or at maximum possible looseness, so will therefore function regardless of the cap's rotational position prior to assembly. Further, because the lugs and ratchet teeth are disposed completely around the cap and neck, a fully circumferential interlock between the frangible tamper-indicator and the neck collar is provided which yields a more positive interlock and a causes the frangible tamper-indicator to tear from the cap prior to unscrewing for true tamper-indication. As a result of the thread and interlock feature arrangement of the present invention, a snap-on assembly is provided which negates the need for an orientation feature in the cap or a one-way rotatable ratchet, and which provides tight and reliable sealing regardless of the cap's rotational position relative to the neck at assembly.

In an alternative embodiment, the tamper-evident lower skirt is constructed of a plurality of sections, each section having associated therewith a pull tab. The pull tabs include a first end connected to an outer surface of the lower skirt section and a free end which extends over a slot or space between the sections of the lower skirt. A frangible membrane extends across the slotted space and couples the free end of the pull tab to the lower skirt sections. Upon pulling on any pull tab, the associated frangible membrane is first broken, exposing a slot. This step is followed by removal of the tamper-indicating skirt from the upper skirt by breaking the frangible bridges therebetween. The remaining frangible membranes remain intact, allowing the lower skirt to be completely removed by the upper skirt in a single piece.

It is the object of the present invention to provide a cap and neck-finish configuration for a blow-molded plastic container which is more easily adapted for automatic assembly.

It is the further object to provide a snap-on screw-off cap and neck-finish configuration which provides a secure and reliable seal.

It is the further object to provide a snap-on screw-off cap and neck-finish configuration having improved tamper-indication.

It is the further object to provide a snap-on screw-off cap and neck-finish configuration which provides positive sealing, yet does not require or allow post-tightening of the cap.

It is the further object to provide a snap-on screw-off cap and neck-finish configuration having tamper-indication which is easily accessed by both right-handed and left-handed users.

Further objects and advantages of the present invention will be best appreciated and more fully understood in reference to the herein described preferred embodiment and the appended drawings, of which the following is a brief description.

DESCRIPTION OF THE PREFERRED EMBODIMENT OF THE INVENTION

The preferred embodiment of the present invention is depicted in FIGS. 1 through 11J.

Figure 9:
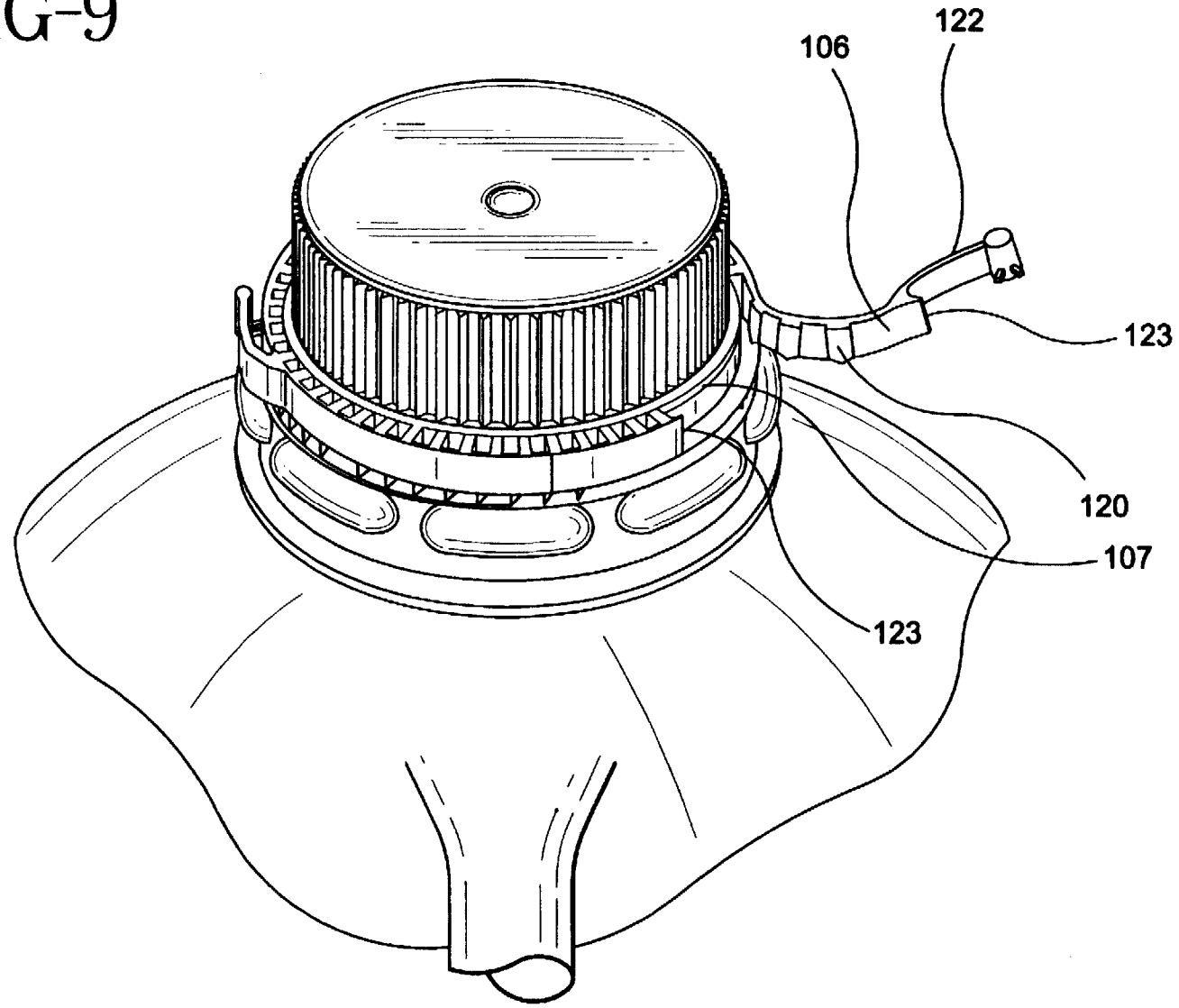
FIG. 9 is an assembled perspective view of the cap and container of FIG. 1 having the tamper-indicating right partially removed.
Figure 11A:
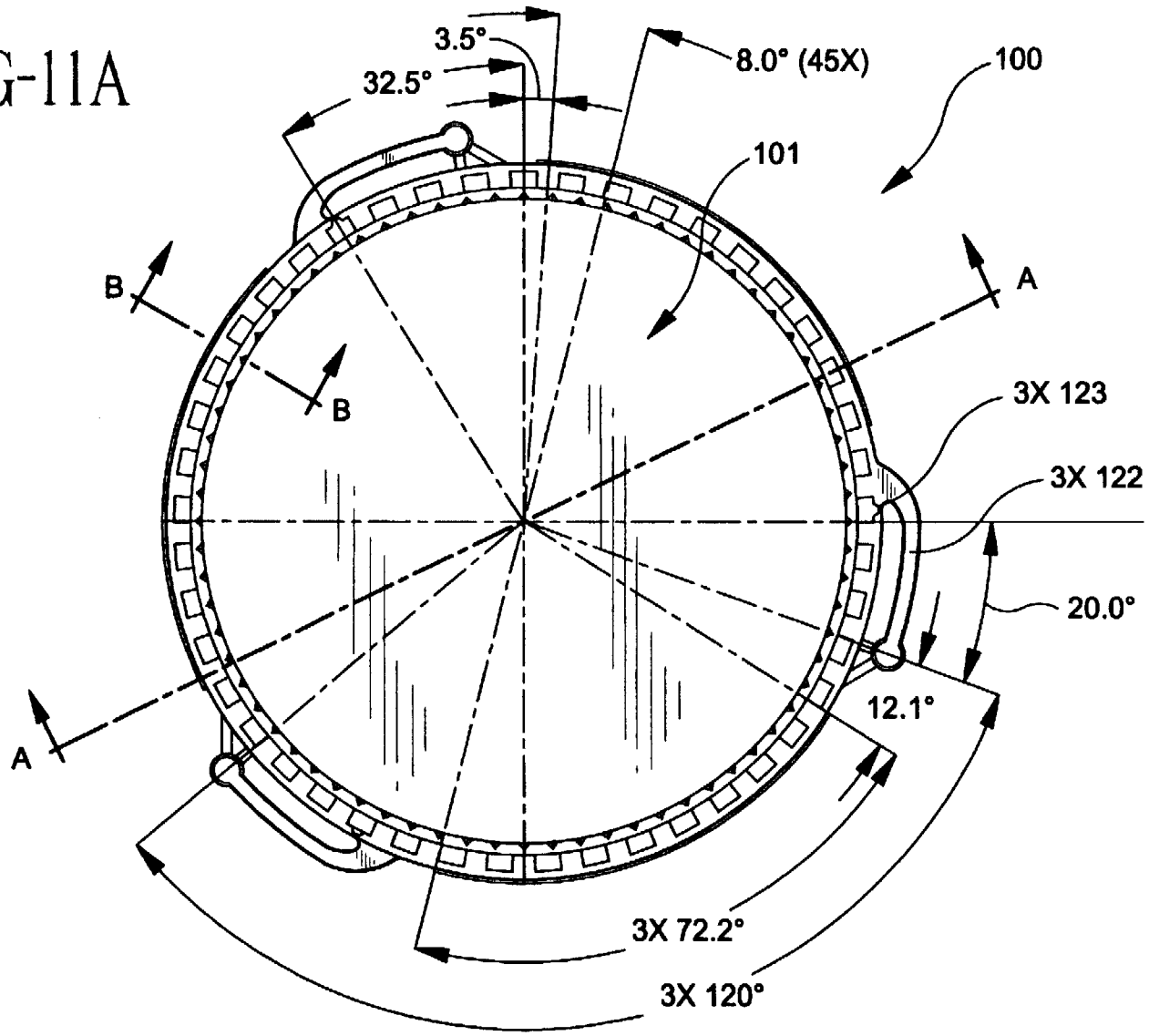
FIG. 11A is a dimensioned top view of the cap of FIG. 1.
Figure 11B:
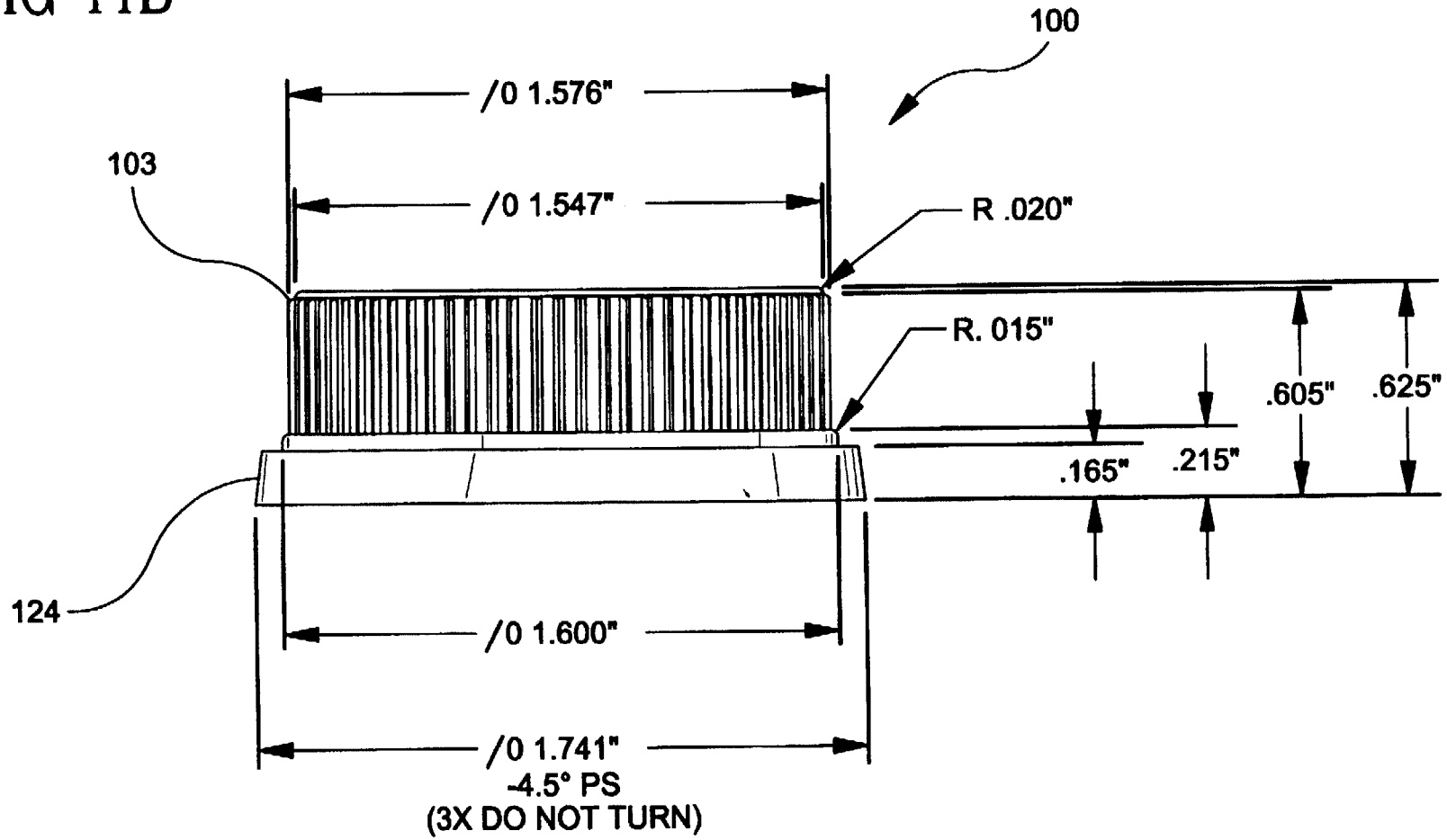
FIG. 11B is a dimensioned side view of the cap of FIG. 1.
Figure 11C:
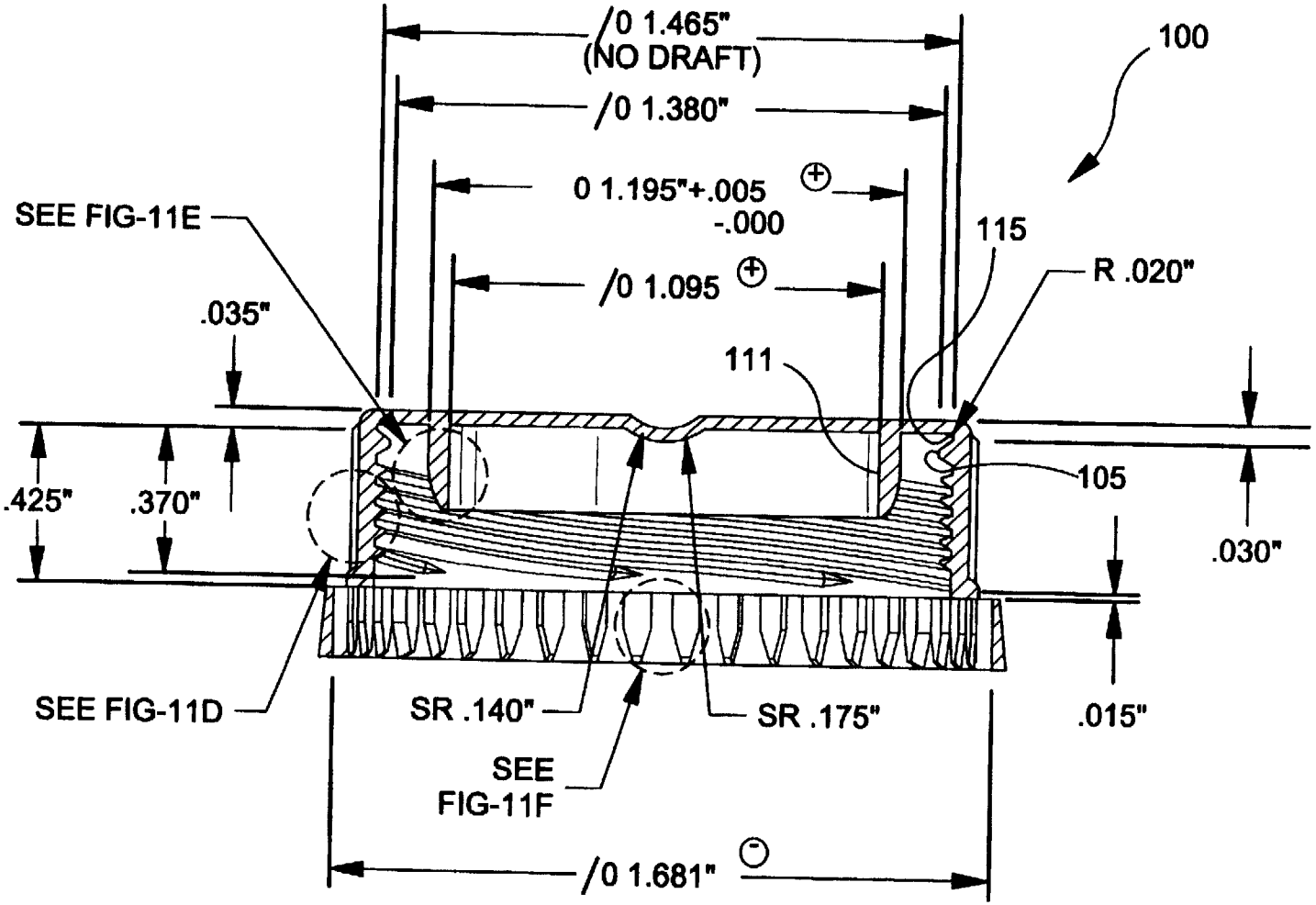
FIG. 11C is a dimensioned sectional view of the cap of FIG. 1.
Figure 11D:
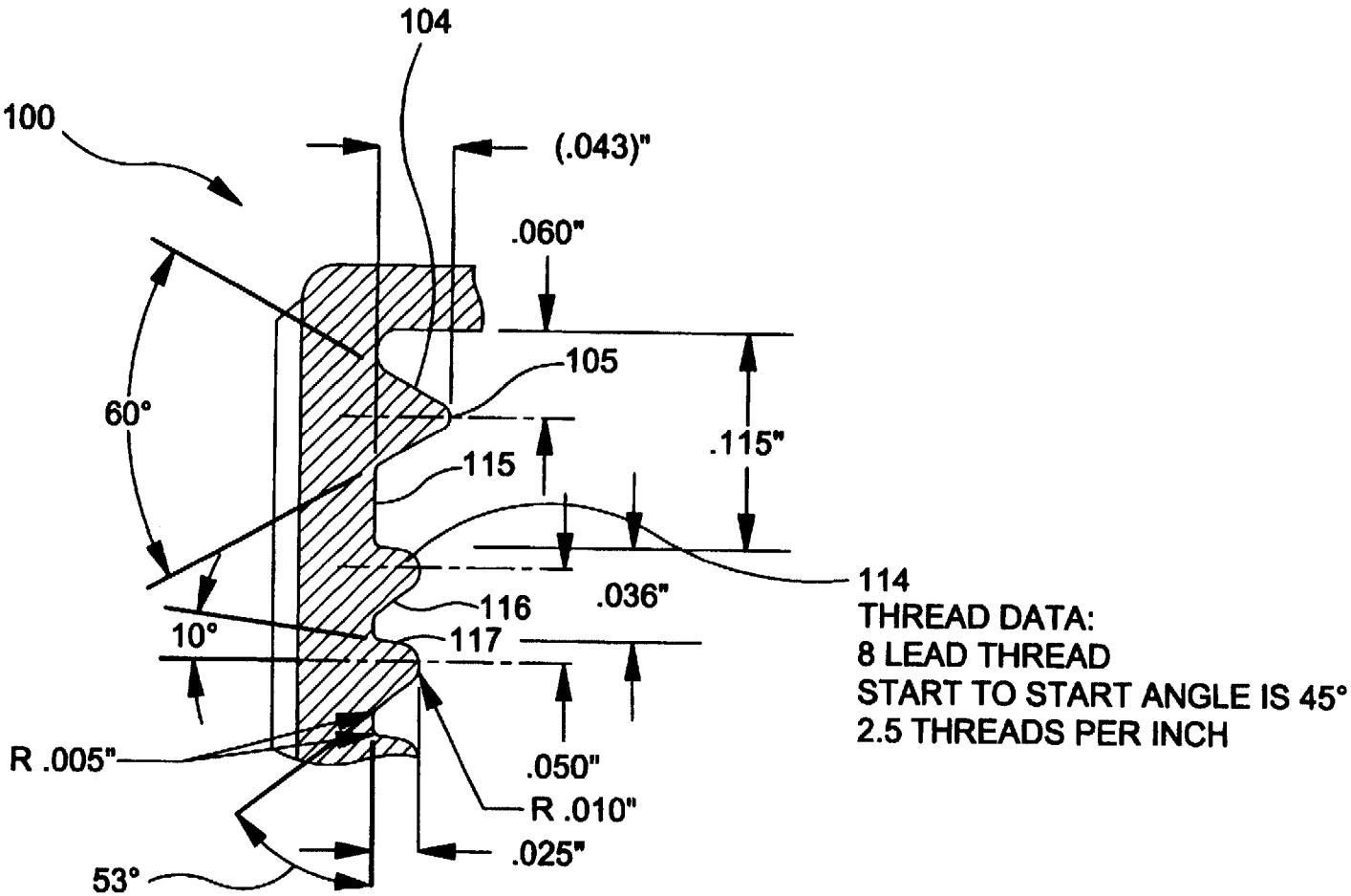
FIG. 11D is a dimensioned partial sectional side view of the threads and wiper of the cap of FIG. 1, drawn at a scale of ten-to-one.
Figure 11E:
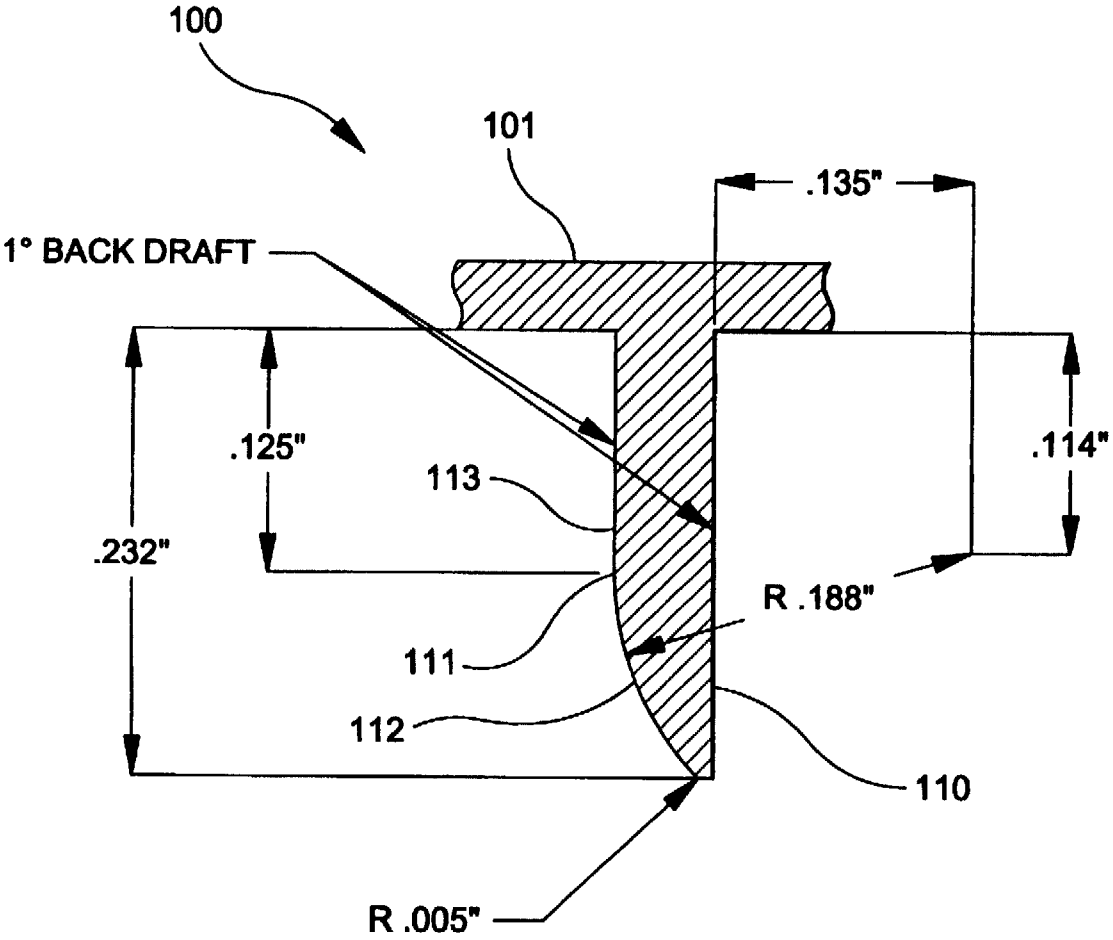
FIG. 11E is a dimensioned partial sectional side view of the valve wall of the cap of FIG. 1, drawn at a scale of ten-to-one.
Figure 11F:
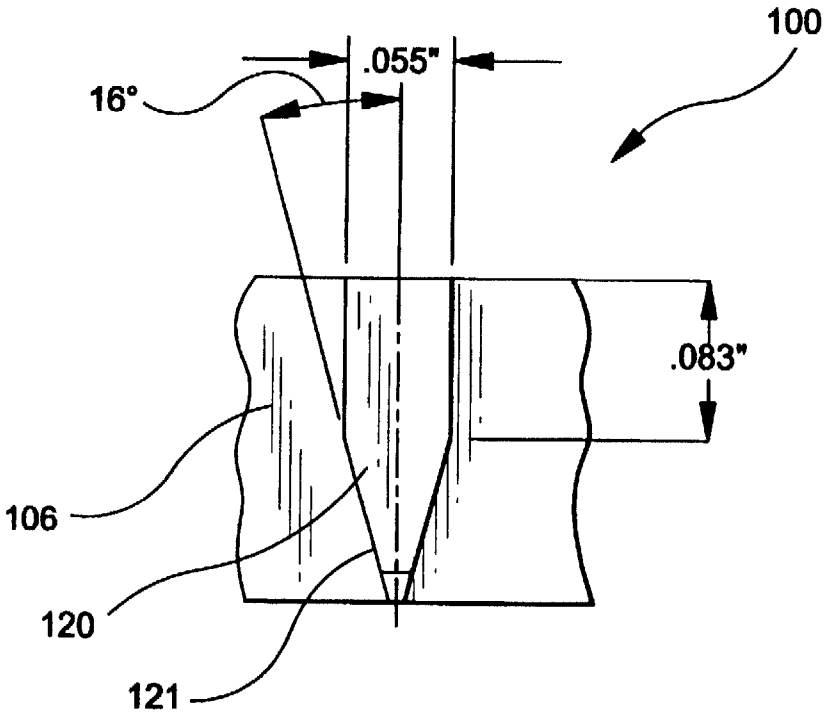
FIG. 11F is a dimensioned interior view of a lug of the cap of FIG. 1, drawn at a scale of ten-to-one.
Figure 11G:
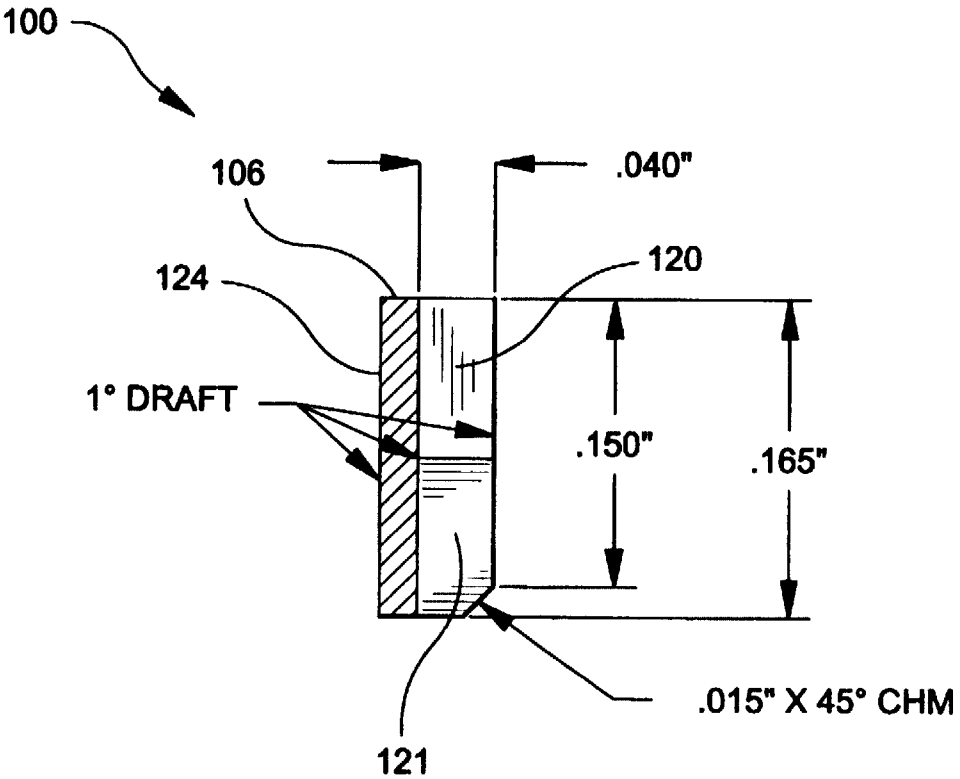
FIG. 11G is a dimensioned partial sectional side view of a lug of the cap of FIG. 1, drawn at a scale of ten-to-one.
Figure 11H:
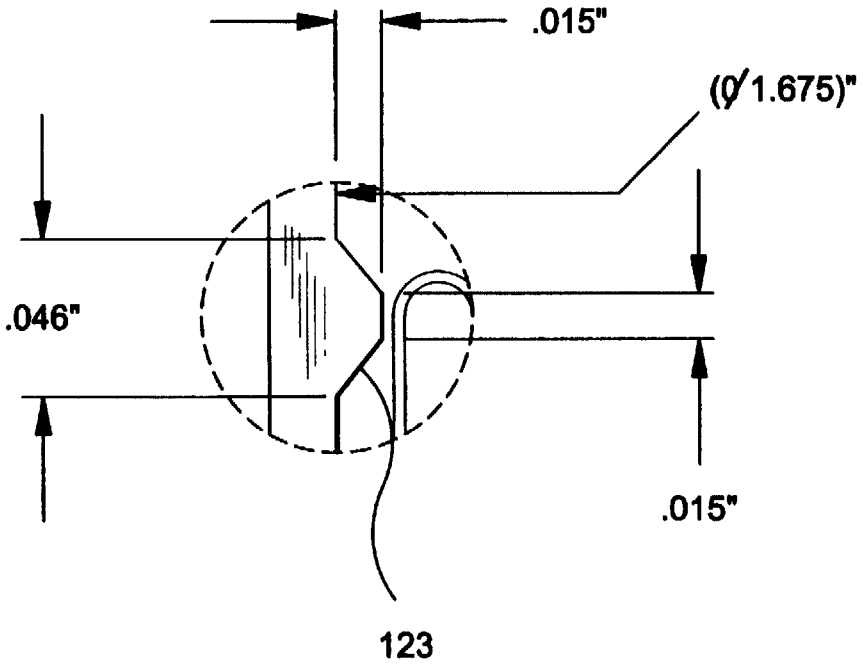
FIG. 11H is a dimensioned top view of a vertical tear grove of the cap of FIG. 1, drawn at a scale of ten-to-one.
Figure 11J:
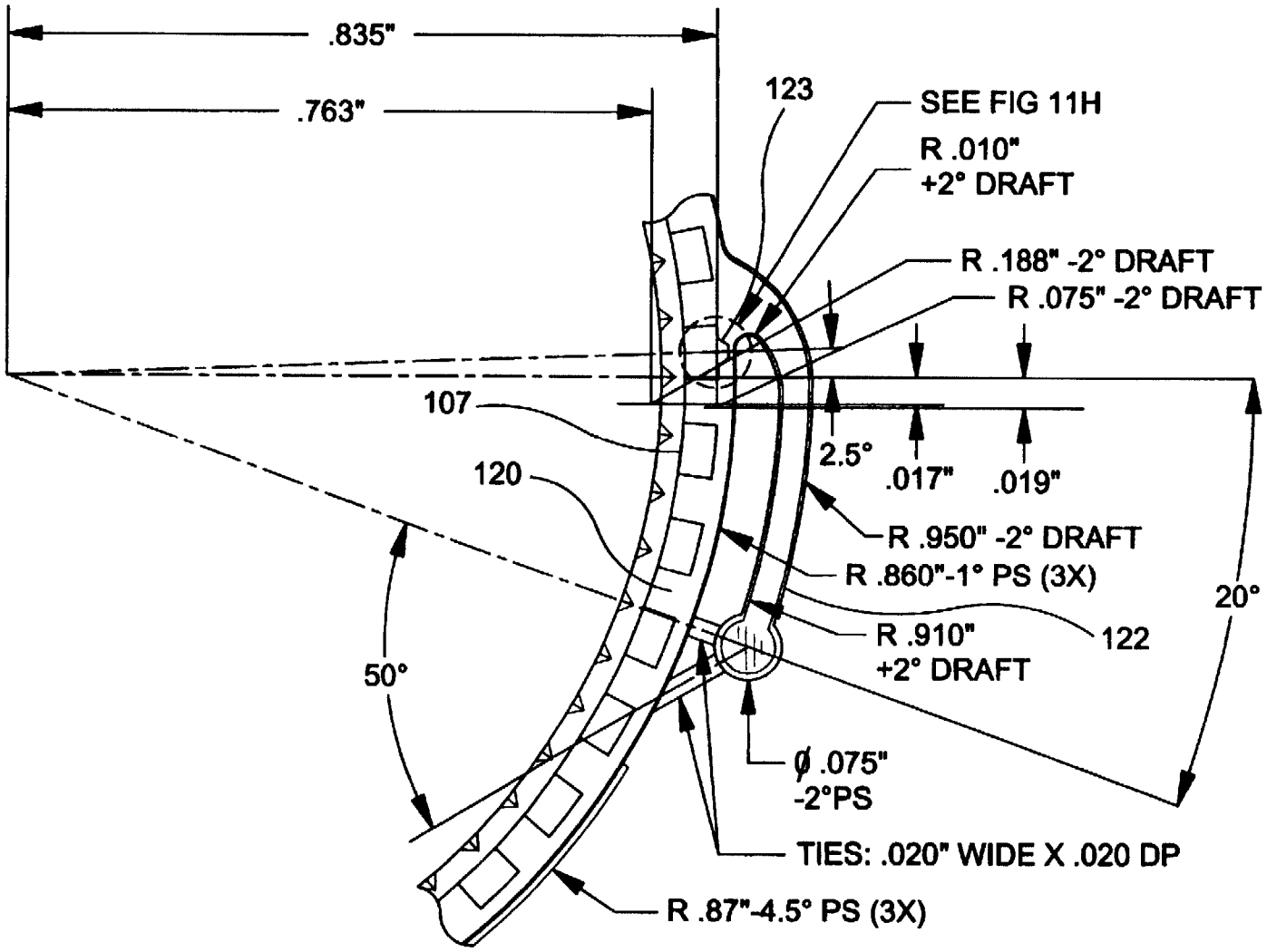
FIG. 11J is a dimensioned top view of a pull tab of the cap of FIG. 1, drawn at a scale of five-to-one.

Cap 100 comprises a plano-circular top 101 having a cylindrical upper skirt 102 depending downwardly from the top's periphery 103. The upper skirt includes annular sealing bead 104 disposed adjacent the cap top and directed horizontally inward to the bead's inner diameter 105. A cylindrical lower skirt 106 is frangibly attached to the upper skirt at annular tear line 107. Also depending from the cap top is annular valve tube 110, having an outer diameter 111 concentric with and spaced inwardly from the upper skirt. The valve tube's outer surface is substantially spherical at it's lower end 112, as shown in FIG. 11E, and reverse-tapered at it's upper end 113, with it's maximum horizontal diameter 111 disposed below the annular sealing bead. The upper skirt 102 further includes eight helical internal threads 114, arranged equally about the inner diameter 115 of the skirt to form an eight-threaded screw-thread having each thread separated about the cap forty-five angular degrees. Reference to FIG. 11D shows that the threads approximate the Modified-Buttress type, each having steep lead surface 116, sloped fifty-three angular degrees below horizontal, and shallow engagement surface 117, sloped ten angular degrees above horizontal. The lower skirt 106 includes forty-five internal lugs 120 equally disposed about the skirt, each having tapered lower tips 121. The lugs are best understood by reference to FIGS. 11F and 11G. The lower skirt further includes three pull tabs 122, each adjacent a vertical tear groove 123, and equally disposed about the outer diameter 124 of the lower skirt. The preferred embodiment having three pull tabs provides that at least one pull tab will be convenient to the user regardless of the direction at which the cap is approached. This benefit adapts the cap well to both right-handed and left-handed users. The vertical tear grooves are somewhat stronger than the annular tear line 107, and the ring is thereby adapted so that pulling on a pull tab will first break the adjacent vertical tear groove, then break the annular tear line all around with the remaining vertical tear grooves remaining intact, as depicted in FIG. 9.

Figure 10A:
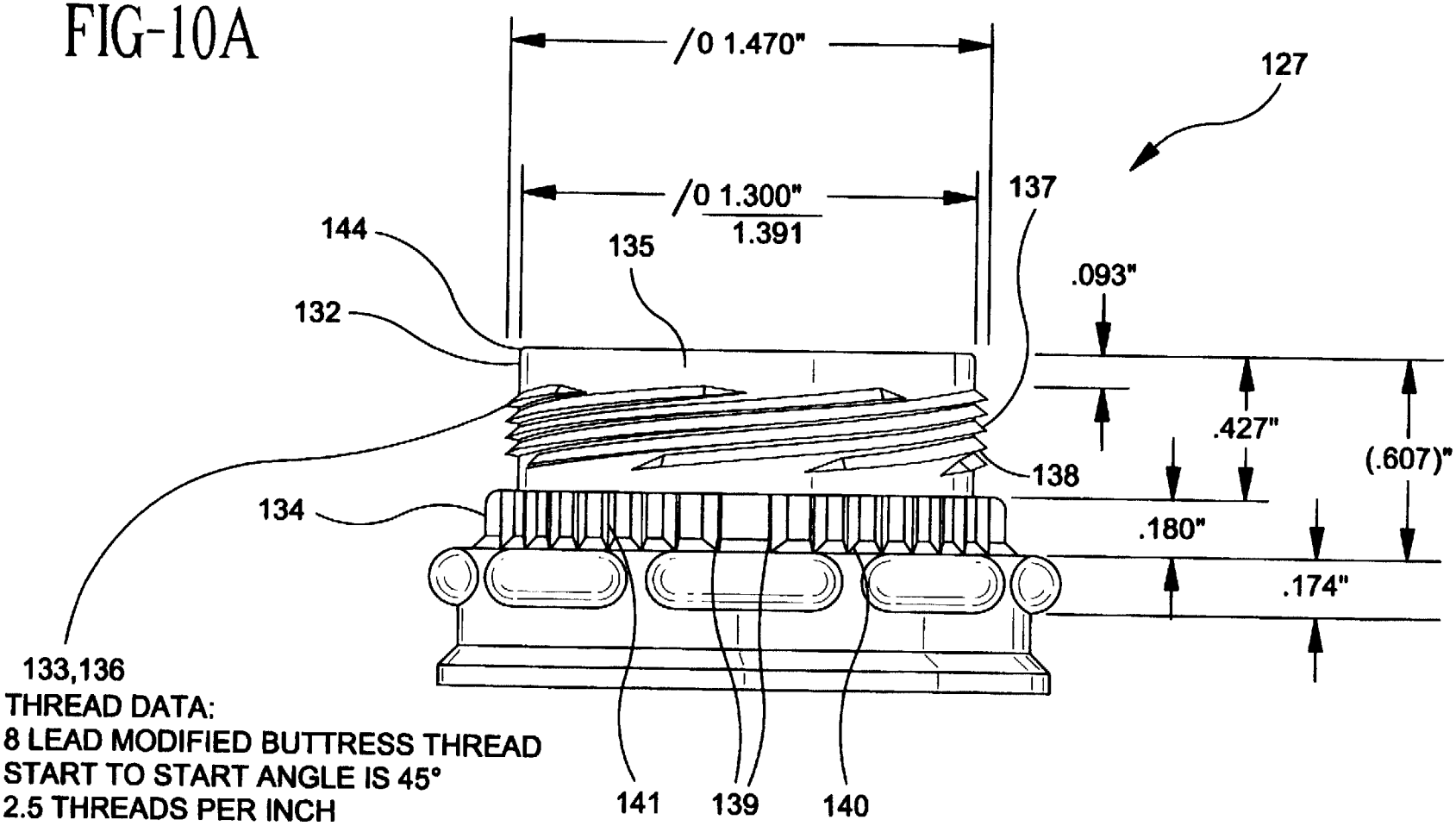
FIG. 10A is a dimensioned side view of the neck of the container of FIG. 1.
Figure 10B:
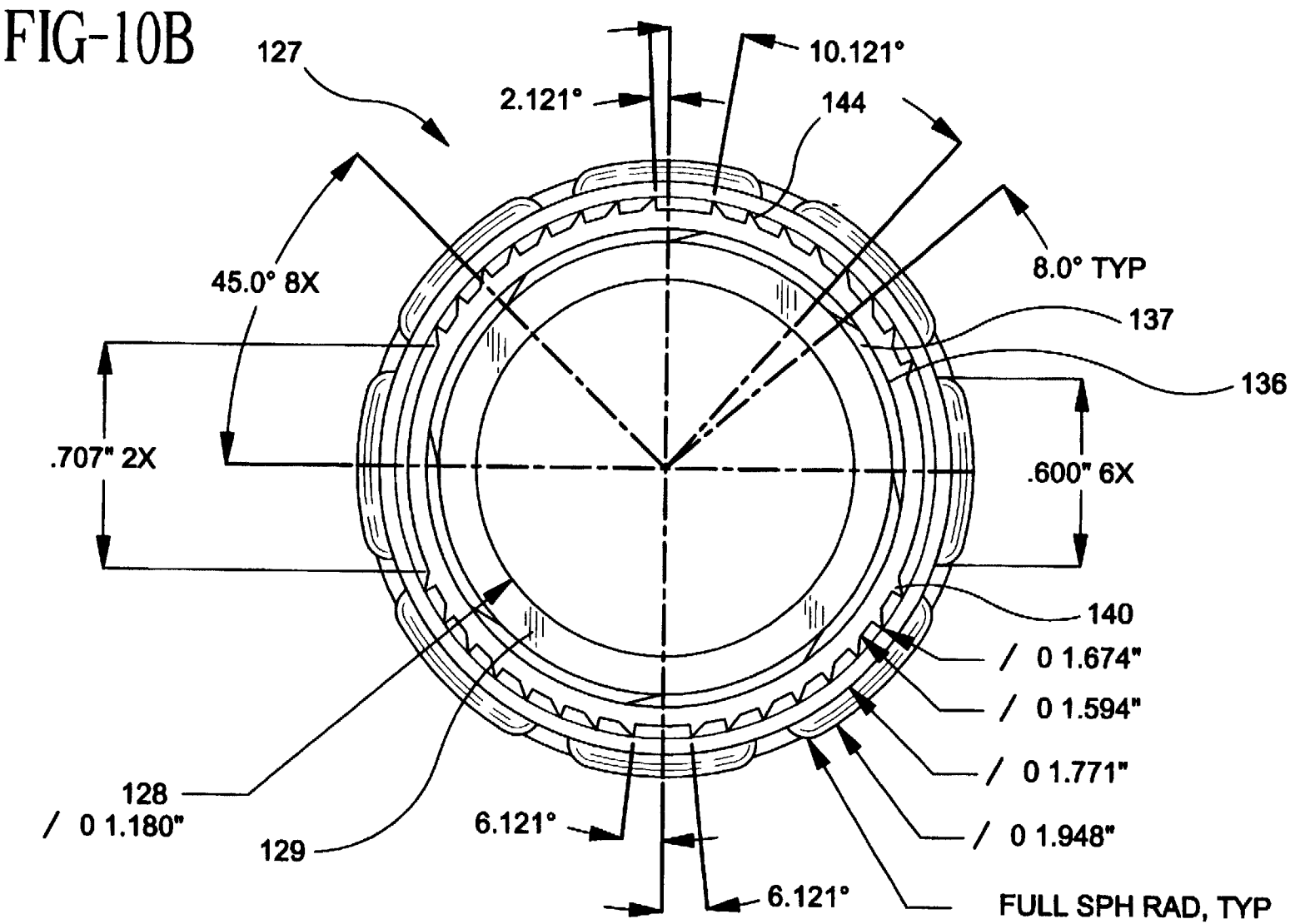
FIG. 10B is a dimensioned top view of the neck of the container of FIG. 1.

The container 125 is a typical blow-molded bottle 126 having a centrally disposed neck 127. The neck is substantially cylindrical and includes circular opening 128 through the top thereof, such that inwardly directed annular flange 129 is formed. The neck opening is slightly smaller in diameter than the horizontal diameter 111 of the cap's spherical valve tube. Depending downwardly from the neck's upper periphery is a cylindrical stretch 132, then a threaded stretch 133, then a collar 134, the collar being adjacent the container bottle 126. The outer diameter 135 of the cylindrical stretch is slightly larger than the cap sealing bead's inner diameter 105. The threaded stretch includes eight helical external threads 136, arranged equally about the outer diameter of the stretch to form an eight-threaded screw-thread having the threads separated about the neck forty-five angular degrees. Reference to FIG. 10A shows the threads are of the Modified-Buttress type, each having steep lead surface 137 and shallow engagement surface 138, these surfaces being oppositely directed from those of the cap. The collar includes thirty-two ratchet teeth 139 grouped about the collar to accept and engage the cap's lugs 120. Clockwise ratchet teeth 140 retain the lugs from counter-clockwise rotation, and counter-clockwise ratchet teeth 141 retain the lugs from clockwise rotation.

Assembly of the cap and neck is accomplished by direct axial application of the cap onto the neck, and is depicted in FIGS. 2 through 4B. The lead-in surface of each cap thread slips past the snaps over the lead-in surface of each neck thread. The tapered lower tips of the lugs direct the lugs in-between adjacent ratchet teeth, and the lugs become fully engaged with the ratchet teeth as the valve tube is forced into the neck opening. The neck opening is firmly and sealingly stretched around the valve wall. Simultaneously, the sealing bead of the cap engages the neck's cylindrical stretch and the smaller inner diameter of the bead is firmly pulled over the larger diameter of the cylindrical stretch. The larger diameter of the valve tube interferes with and expands the smaller neck opening so that the upper periphery 144 of the neck's cylindrical stretch is enlarged slightly in diameter and further seals against the bead.

The sealing effect is enhanced by the cooperation of the valve tube/opening interference fit and the bead/cylindrical stretch interference fit. The outward pressure on the opening by the valve acts to enlarge the neck's upper periphery above the bead, improving sealing and engagement of the cap and neck. Inward pressure of the bead on the cylindrical stretch acts to reduce the opening diameter above the valve tube's maximum diameter, improving sealing and engagement of the cap and neck.

The vertical disposition of the bead ensures that it will always lie around the cylindrical stretch regardless of the rotational relationship between the cap and neck at assembly. The eight-thread configuration allows that the cap's rotational position relative to the neck may vary within forty-five rotational degrees. The lead of the eight-thread screw at two and one-half threads per inch is four-tenths of an inch, so that the pitch of the thread arrangement is fifty-thousandths of an inch. The cap's axial position relative to the neck may thereby vary within that fifty-thousandths. The vertical disposition of the bead must therefore be no less than fifty-thousandths of an inch below the upper periphery of the cylindrical stretch in its intended position. The cylindrical stretch must be a minimum of fifth-thousandths of an inch tall to accommodate all possible dispositions of the bead.

Axial removal of the cap from the neck is denied by the mating of the neck's and cap's thread engagement at the respective engagement surfaces. Because rotation is also denied while the lower skirt and upper skirt are intact, by the engagement of the lugs and ratchet teeth, the cap cannot be removed and firm sealing is maintained.

Removal of the cap's lower skirt 106, as depicted in FIG. 9, allows rotation of the cap relative to the neck and the cap can be unscrewed and removed. Removal of the lower skirt further provides tamper-indication by alerting the user that the cap has likely been removed since initial assembly.

Re-attachment of the cap is accomplished by rotational screwing, wherein the sealing system re-engages with each subsequent re-attachment.

Figure 12:
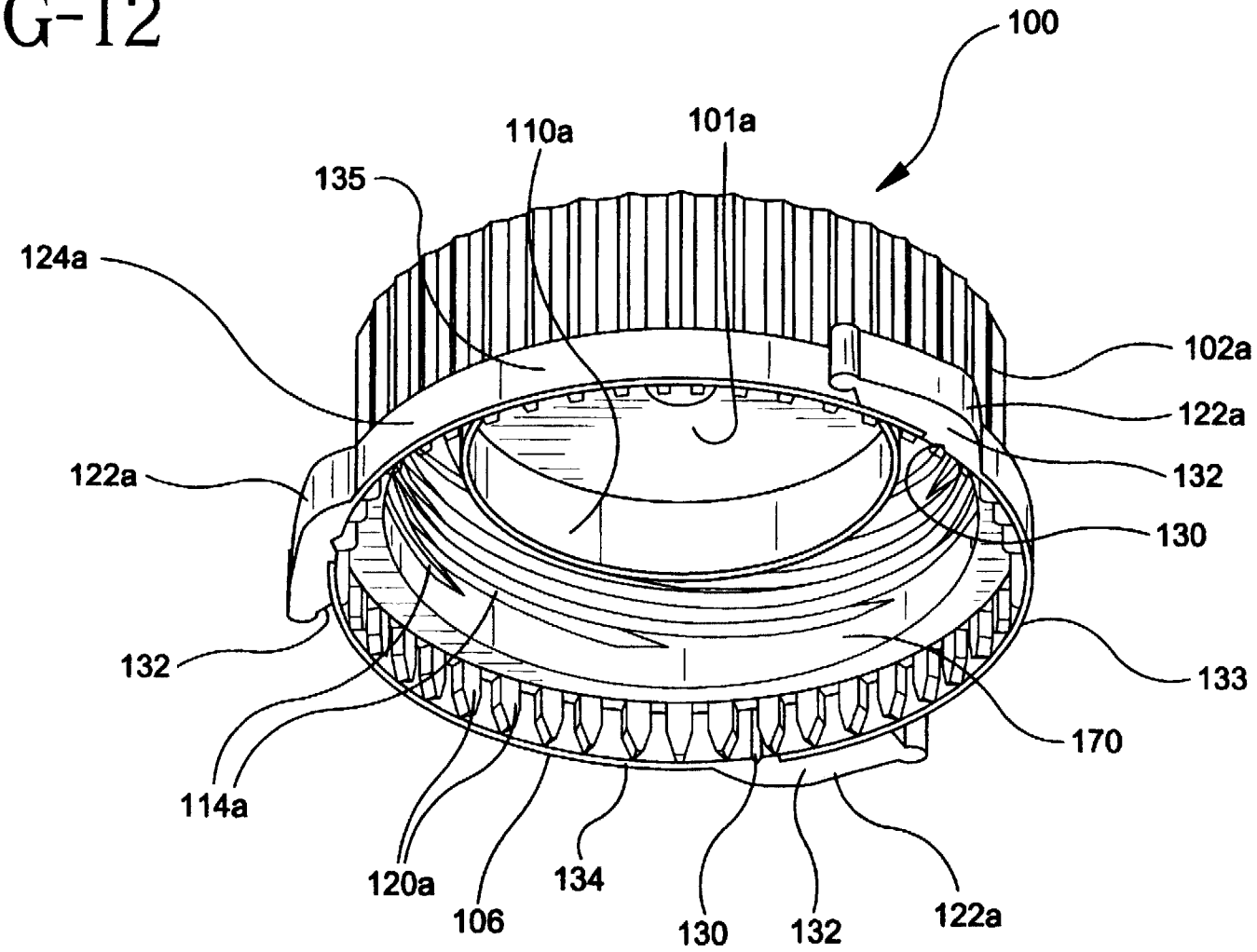
FIG. 12 is a bottom perspective view of an alternative embodiment of a cap formed in accordance with the present invention.

FIG. 12 is a bottom perspective view of an alternative embodiment of a cap 100*a* formed in accordance with the present invention. Like component parts as previously identified have been assigned like reference numerals followed by the letter "a". The cap 100*a* illustrated in FIG. 12 can be used with the bottle and neck finish described with respect to the cap illustrated in FIG. 1. Alternatively, the neck finish may be slightly modified so that the threads do not traverse the parting line of the blow-molded bottle.

Figure 15:
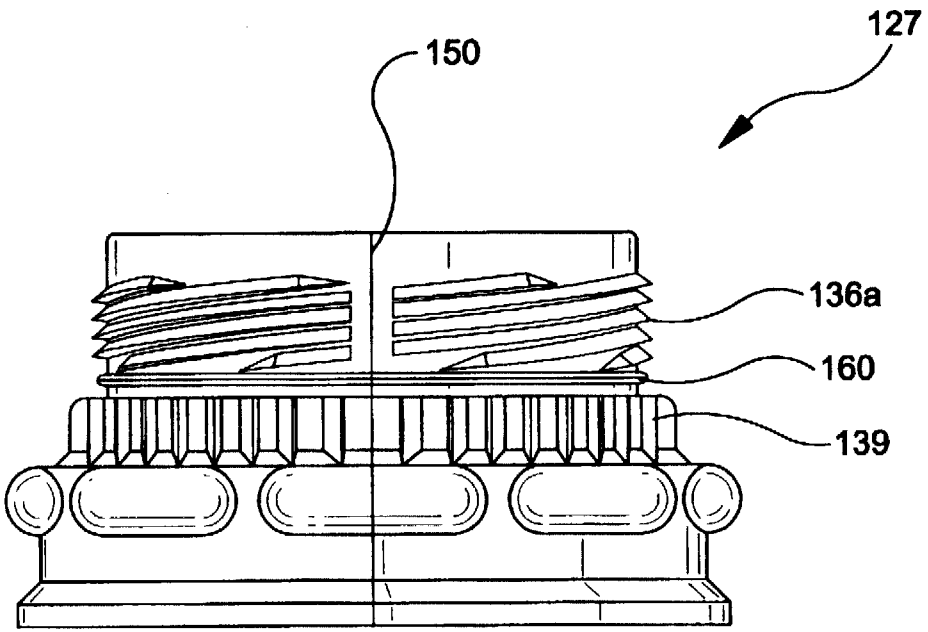
FIG. 15 is a side plan view of an alternative neck of the container having interrupted threads and an annular sealing ring.

Referring to FIG. 15, the bottle neck 127 is illustrated to show the parting line 150 in the neck and the threads 136*a* being interrupted along the parting line to allow easier axial displacement and assembly and disassembly when threading the cap 100*a* onto the neck of the bottle. When forming blow-molded bottles, the mold comprises two halves which produce a parting line at the junction of the mold halves. At this parting line, extra material, or flash occurs. This material is ultimately trimmed; however, a high spot generally remains, especially on the external threads 136*a* located on the bottle neck 127. The flash is present below the pitch diameter of the threads making axial displacement and rotational assembly and disassembly more difficult since the cap threads cannot fully engage the neck threads. To alleviate this problem, each of the external threads 136*a* of the container neck are interrupted and do not traverse the parting line 150. Accordingly, the cap threads will not engage the flash thus providing easier application of the cap to the neck either by axial displacement or threading. It will be appreciated by those skilled in the art that the alternative neck finish described above can be used with many different cap designs.

Furthermore, as illustrated in FIG. 15, the neck finish may include an annular sealing ring 160 located below the threads for engagement with a smooth section 170 of the upper skirt (FIG. 12) to provide a seal thereon. The annular sealing ring 160 along with the valve seal 110*a* provides an effectively leak-proof combination cap and bottle.

The alternative embodiment of the cap shown in FIG. 12 includes a top 101*a*, an upper skirt 102*a* depending downwardly from said top, and a lower skirt 106*a* frangibly attached to the upper skirt 102*a* along an annular tear line. The inner diameter of the upper skirt 102*a* includes a plurality internal lugs 120*a* disposed therein. The cap 100*a* further includes at least one pull tab 122*a* positioned on an external surface of the lower skirt 106*a* and a valve tube 110*a* depending from a lower surface of the cap top 101*a* .

Figure 1:
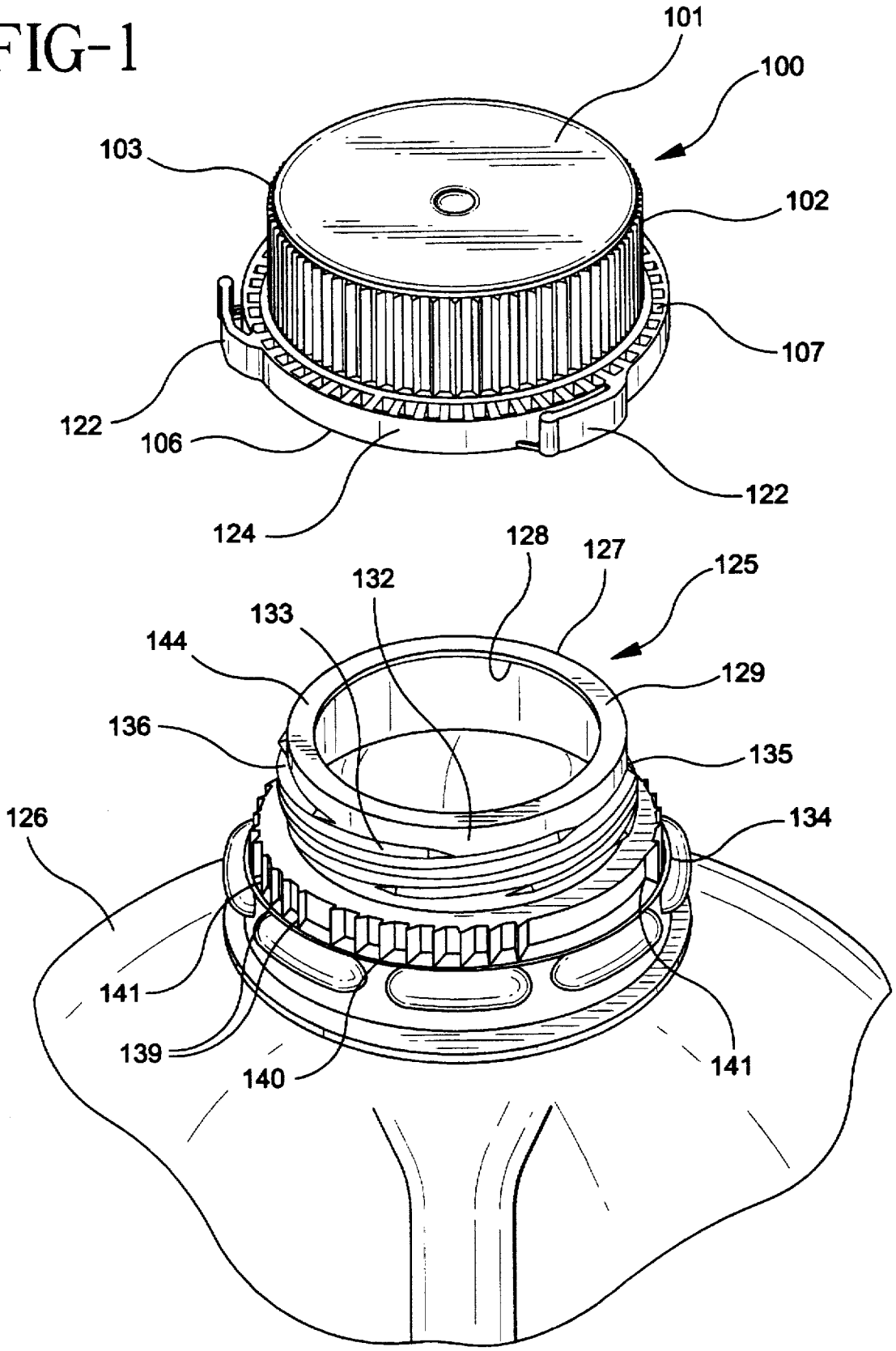
FIG. 1 is an exploded perspective view of a cap and a container in accordance with the present invention.
Figure 2:
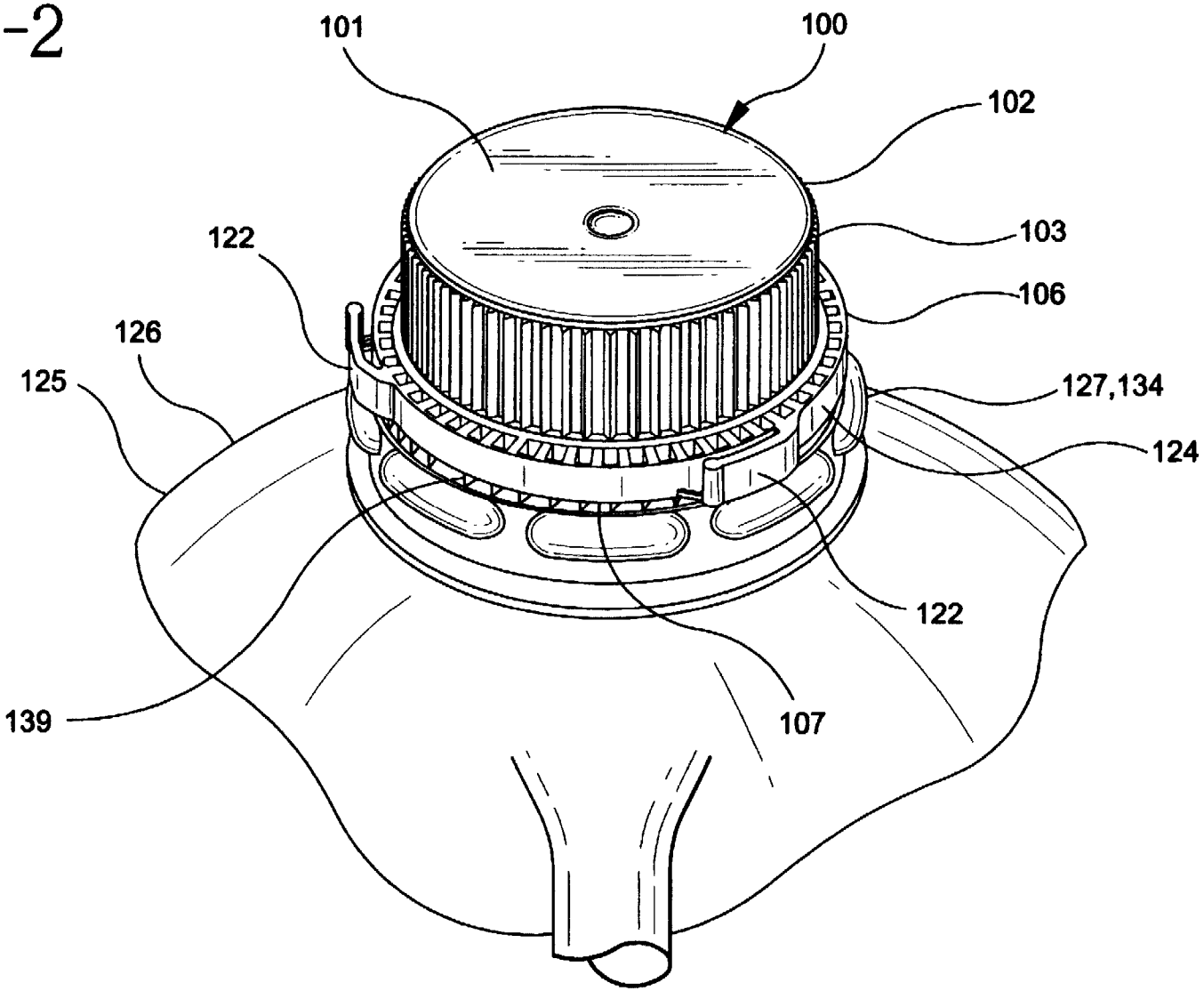
FIG. 2 is an assembled perspective view of the cap and container of FIG. 1.
Figure 3:
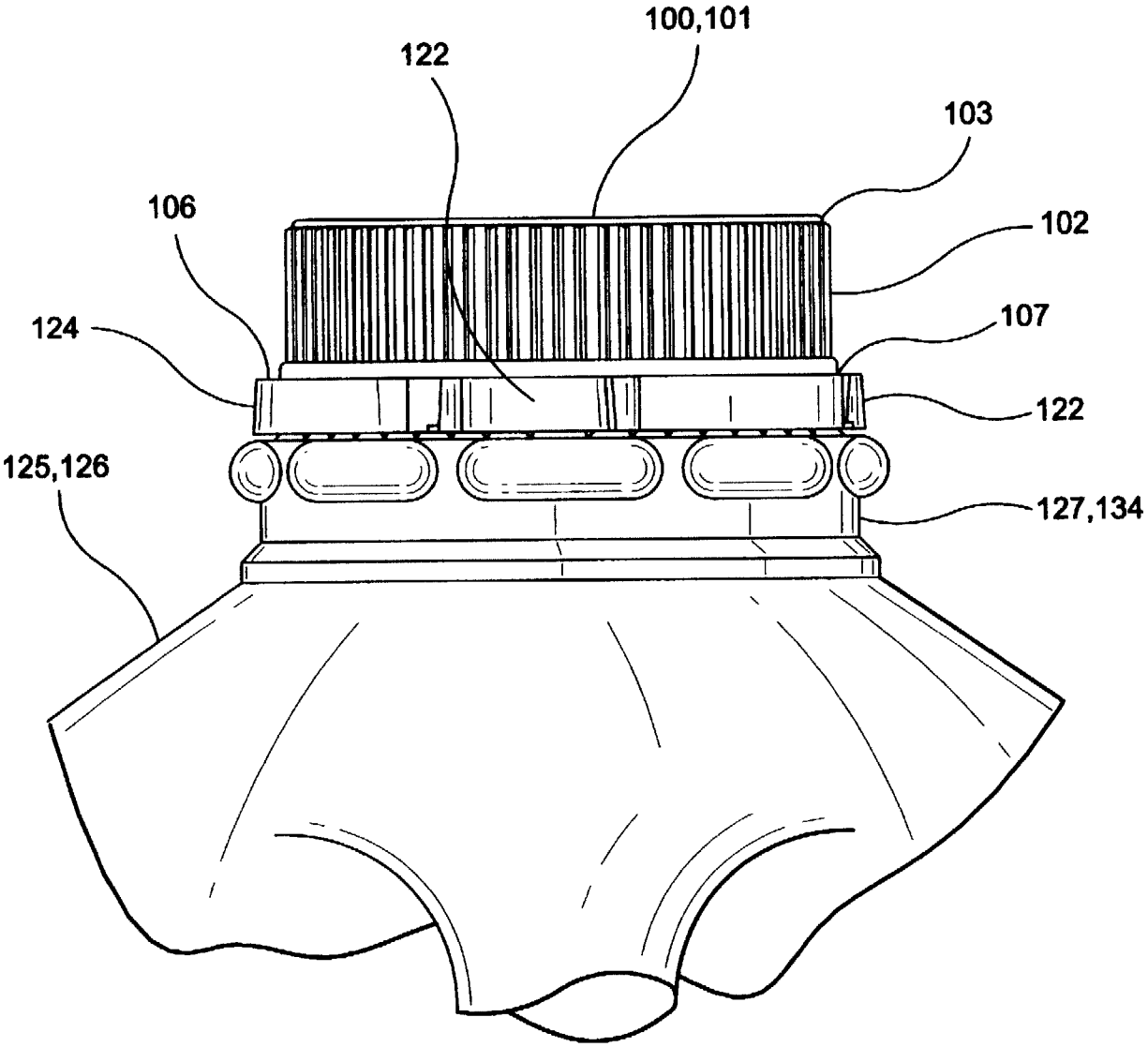
FIG. 3 is an assembled side view of the cap and container of FIG. 1.
Figure 4A:
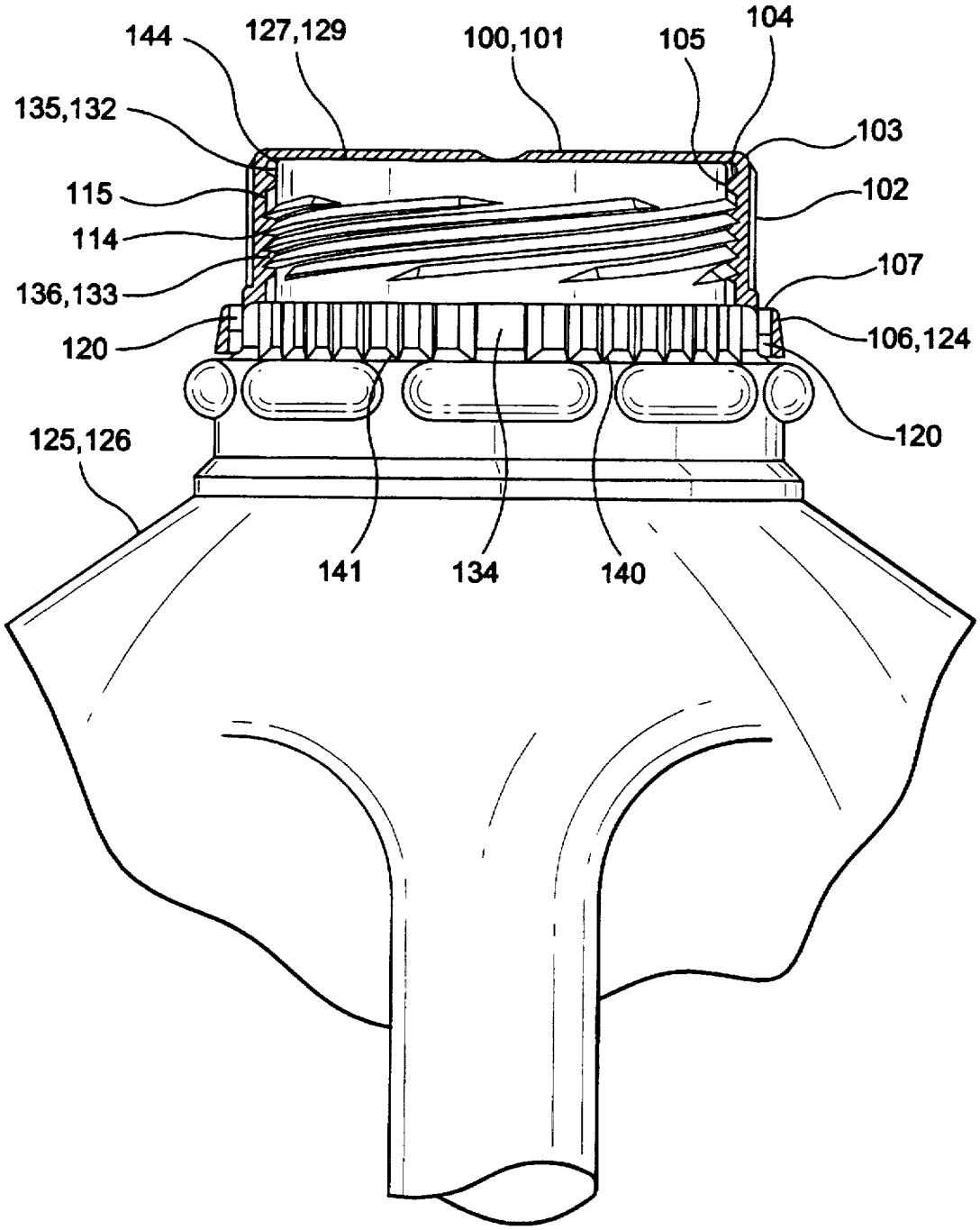
FIG. 4A is a full sectional side view of the cap and container of FIG. 1.
Figure 4B:
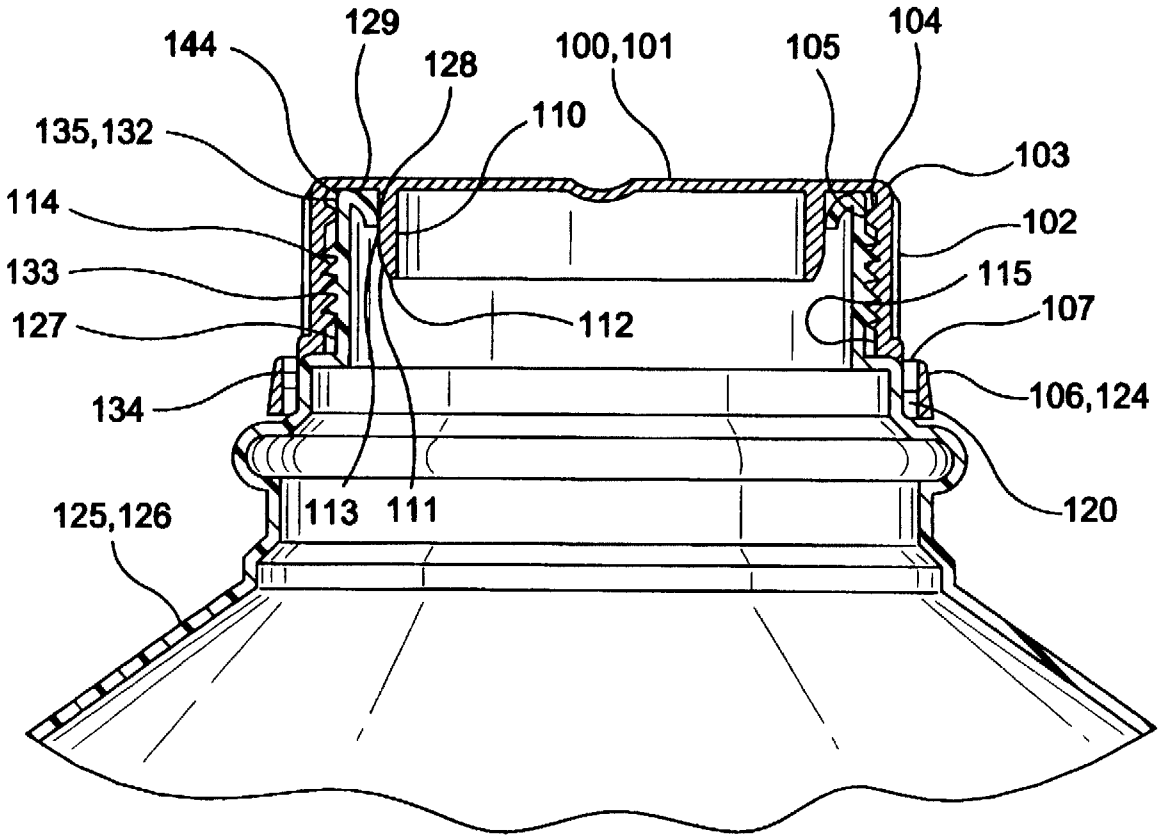
FIG. 4B is a partial sectional side view of the cap and container of FIG. 1.
Figure 13:
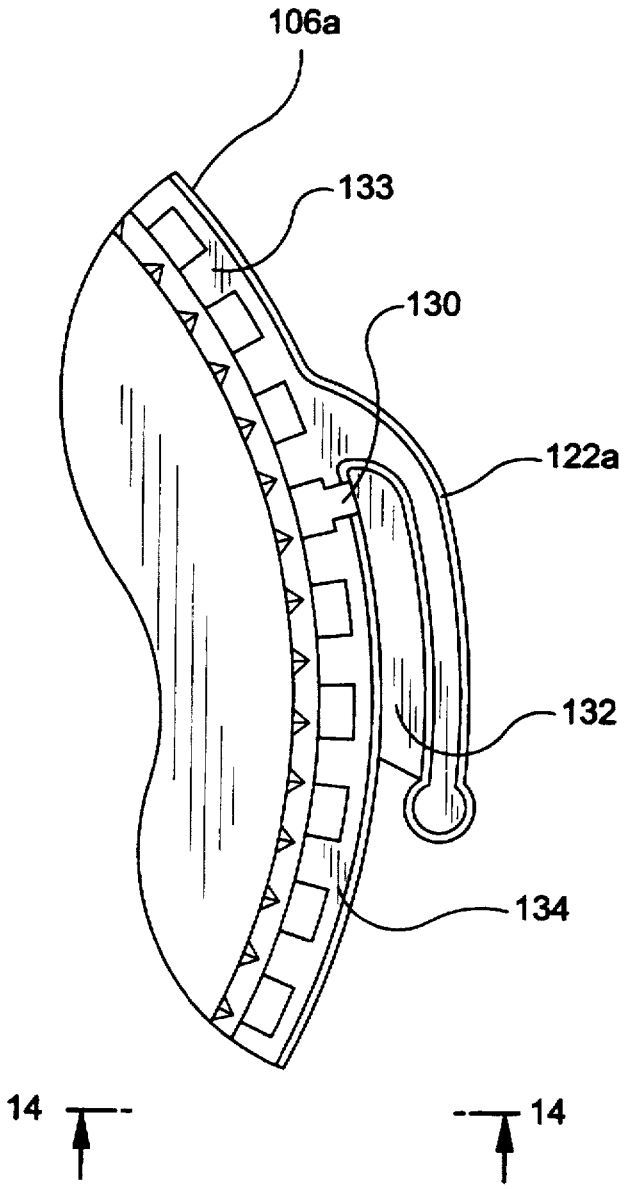
FIG. 13 is a fragmentary top plan view of the alternative cap design illustrated in FIG. 12.

The cap 100*a* is identical to and functions the same as the cap described and shown in FIG. 1, except it includes a sectioned lower skirt having slots 130 and membranes 132 rather than vertical tear initiation grooves. Within the lower skirt and thread-like ties connecting the end of each pull tab with the outer surface of the lower skirt. This tamper-evident ring design is an improvement over the tamper ring disclosed and previously described in U.S. Pat. No. 4,922,684. More specifically, the embodiment illustrated in FIG. 12 includes a lower skirt 106*a* formed in three distinct sections 133, 134, 135, each section being separated from the adjacent section by a slot 130. Referring to FIG. 13, each section 133, 134, 135 has associated therewith a pull tab 122*a* having a first end connected to an exterior surface of the lower skirt section and a second free end which extend substantially parallel to the lower skirt over the slotted space between sections of the lower skirt. A frangible membrane 132 couples adjacent sections of the lower skirt as well as coupling the free end of the associated pull tab to the exterior surface of the lower skirt sections the membrane traverses. As will be appreciated by those skilled in the art, the membrane 132 does not necessarily have to traverse the slot between the lower skirt sections, but merely couples the free end of the pull tab to the lower skirt, provided the membrane is strong enough to allow separation of the lower skirt from the upper skirt as a single unit.

Figure 14:
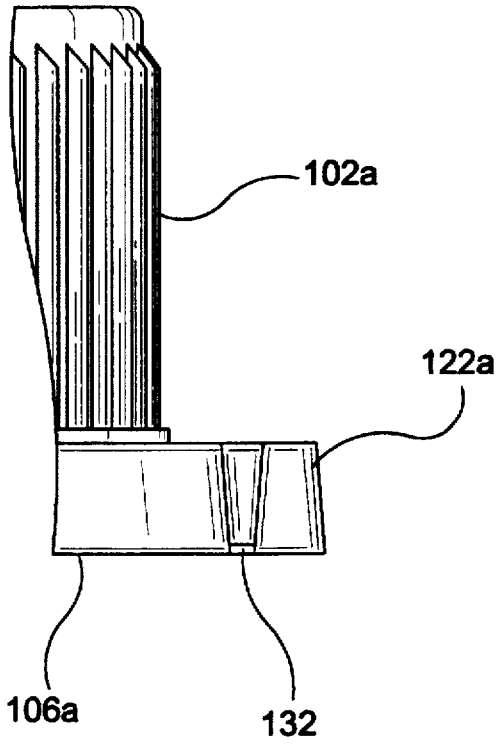
FIG. 14 is a fragmentary side plan view of the alternative cap design illustrated in FIGS. 12 and 13.

FIG. 14 is a fragmentary side plan view of cap illustrated in FIGS. 12 and 13 showing the lower skirt, frangible membrane and pull tab configuration. The membrane 132 is relatively thin with respect to the other components of the cap to allow the membrane to be easily broken upon applying force to the pull tab. Those skilled in the art of molding bottle caps will appreciate that the membrane 132 may be positioned anywhere between the outer periphery of the lower skirt and the free end of the pull tab, e.g., at the top surface or somewhere in the middle as opposed to at a lower surface as shown in FIG. 14.

Assembly of the cap 100*a* onto the neck of a bottle is accomplished by direct axial application of the cap onto the neck. Similar to the cap design described with respect to FIG. 1, the threads 114*a* of the cap matingly engage the threads on the neck and the lugs 122*a* on the cap become engaged with the teeth positioned on the neck finish to prevent relative rotation of the cap with respect to the bottle in both the clockwise and counter-clockwise directions. Accordingly, in order to remove the cap from the bottle, it is necessary to remove the lower skirt 106*a*, i.e., tamper-evident-ring, from the cap.

Figure 5:
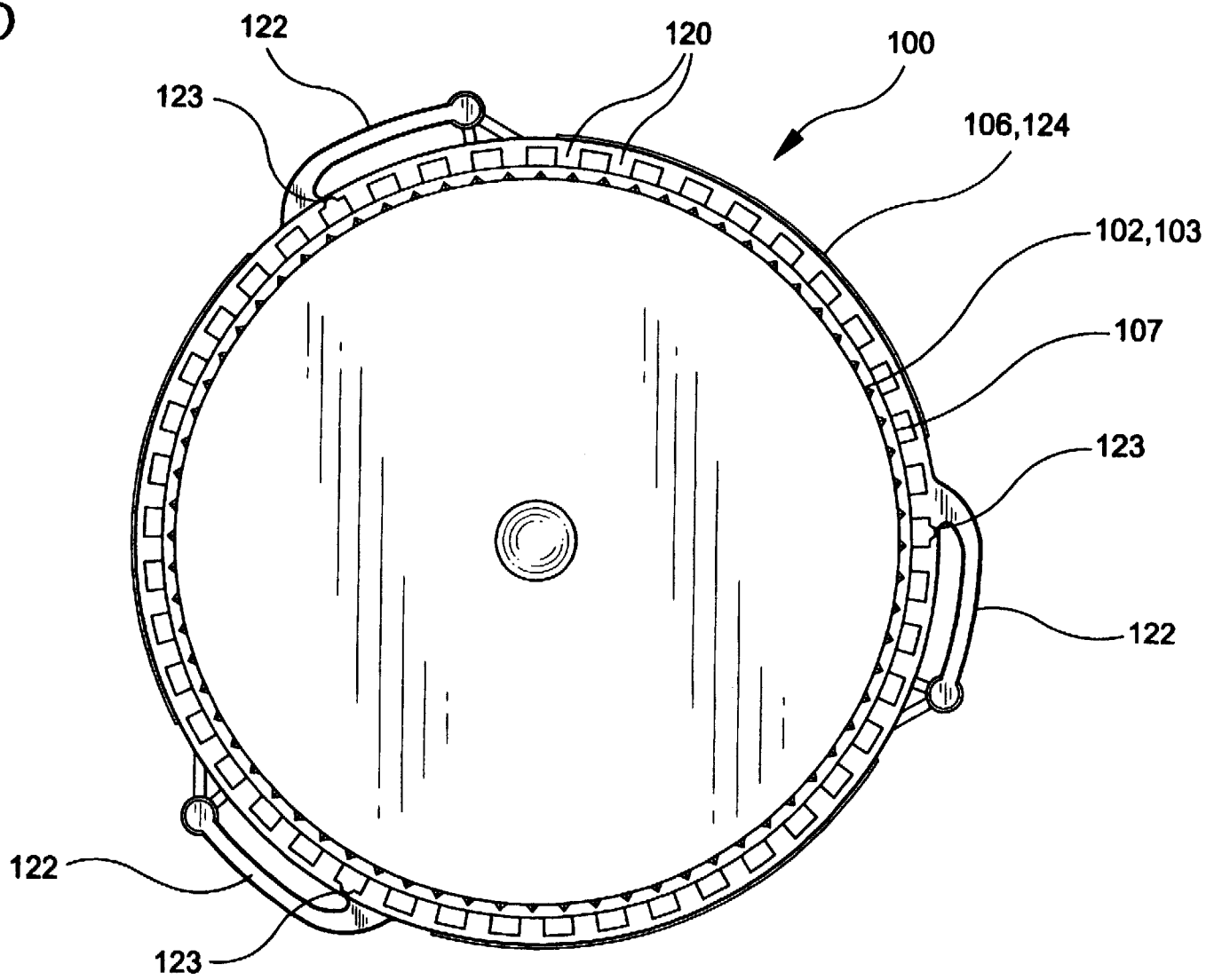
FIG. 5 is an top view of the cap of FIG. 1.
Figure 6:
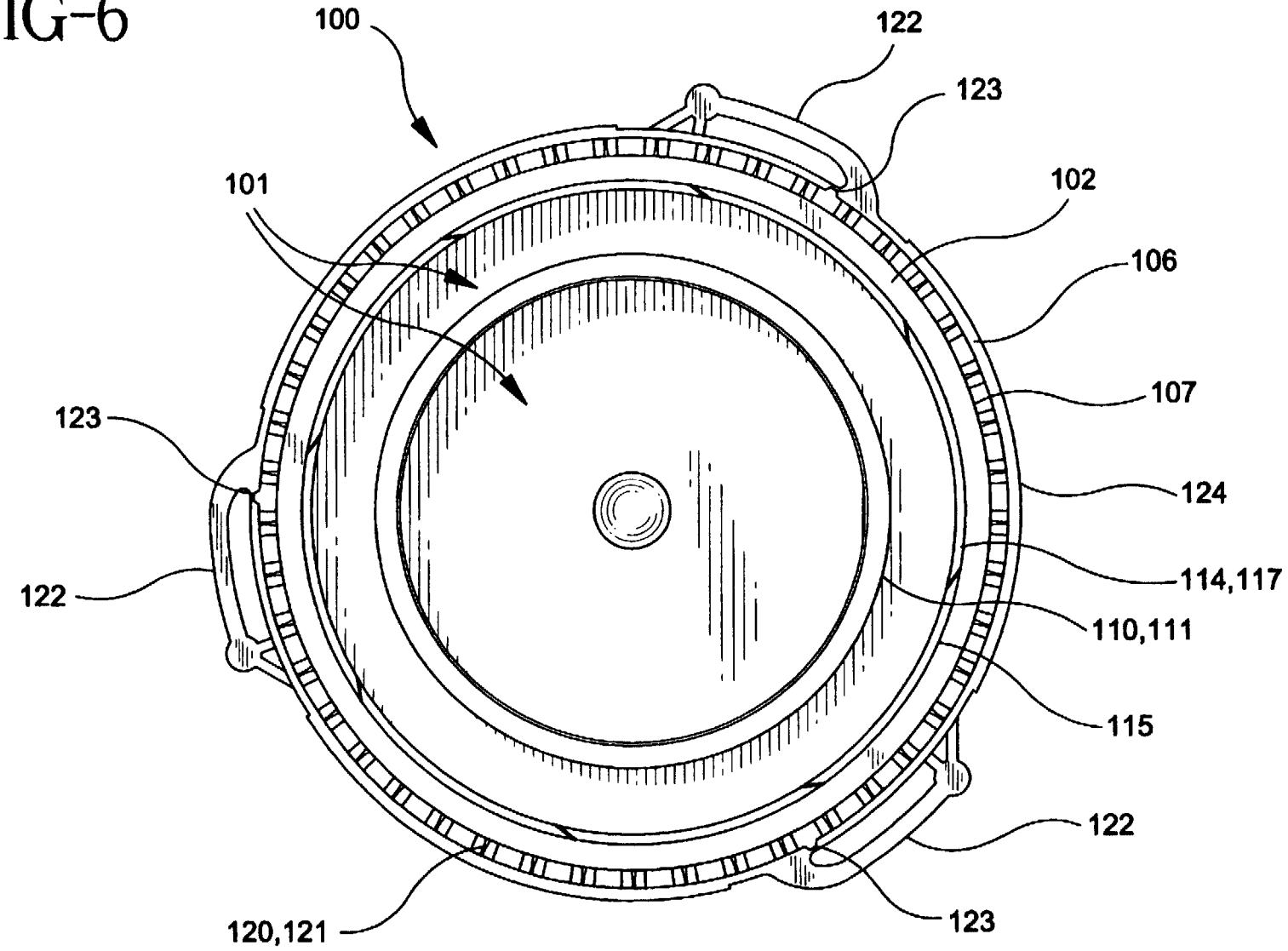
FIG. 6 is an bottom view of the cap of FIG. 1.
Figure 7:
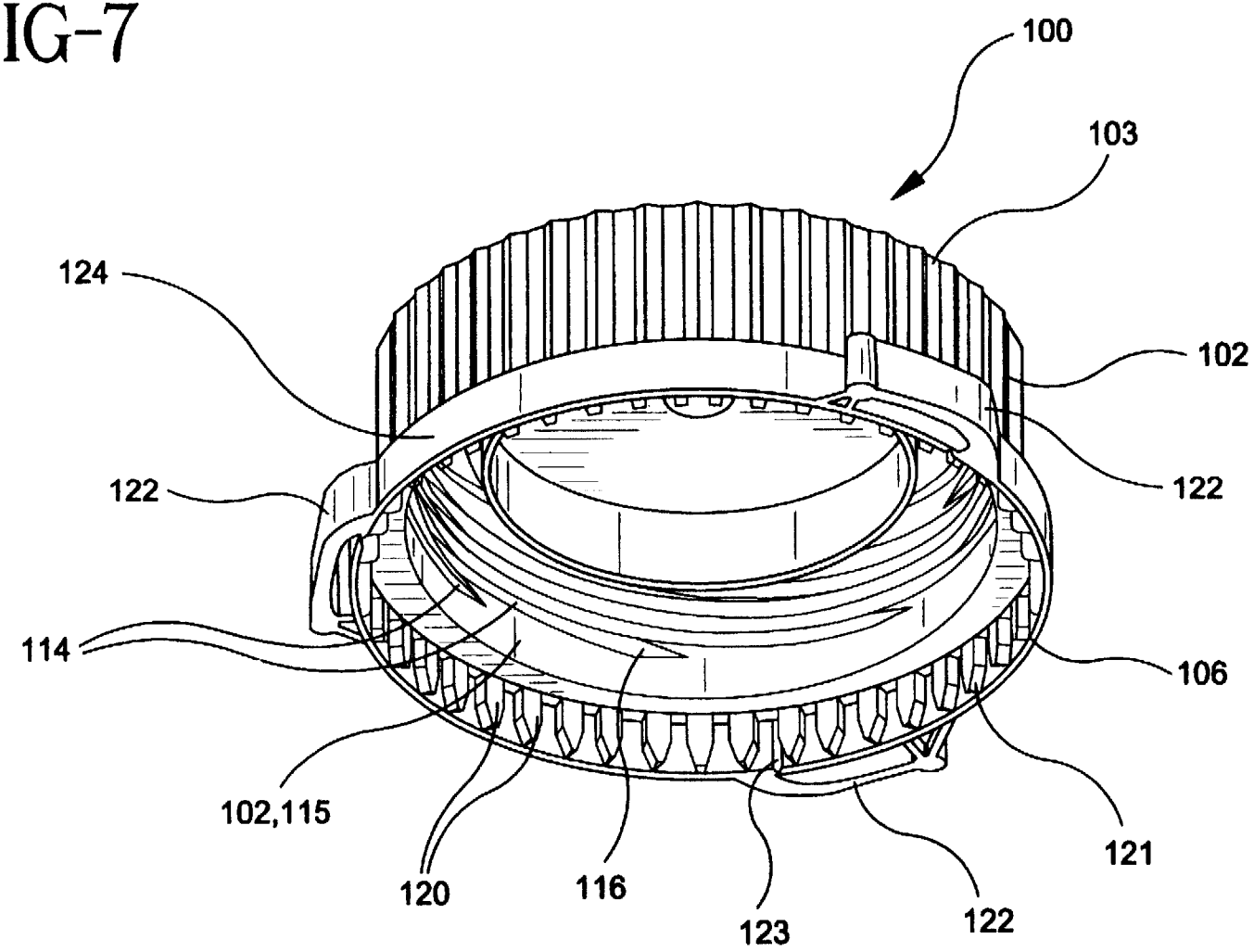
FIG. 7 is an bottom perspective view of the cap of FIG. 1.
Figure 8:
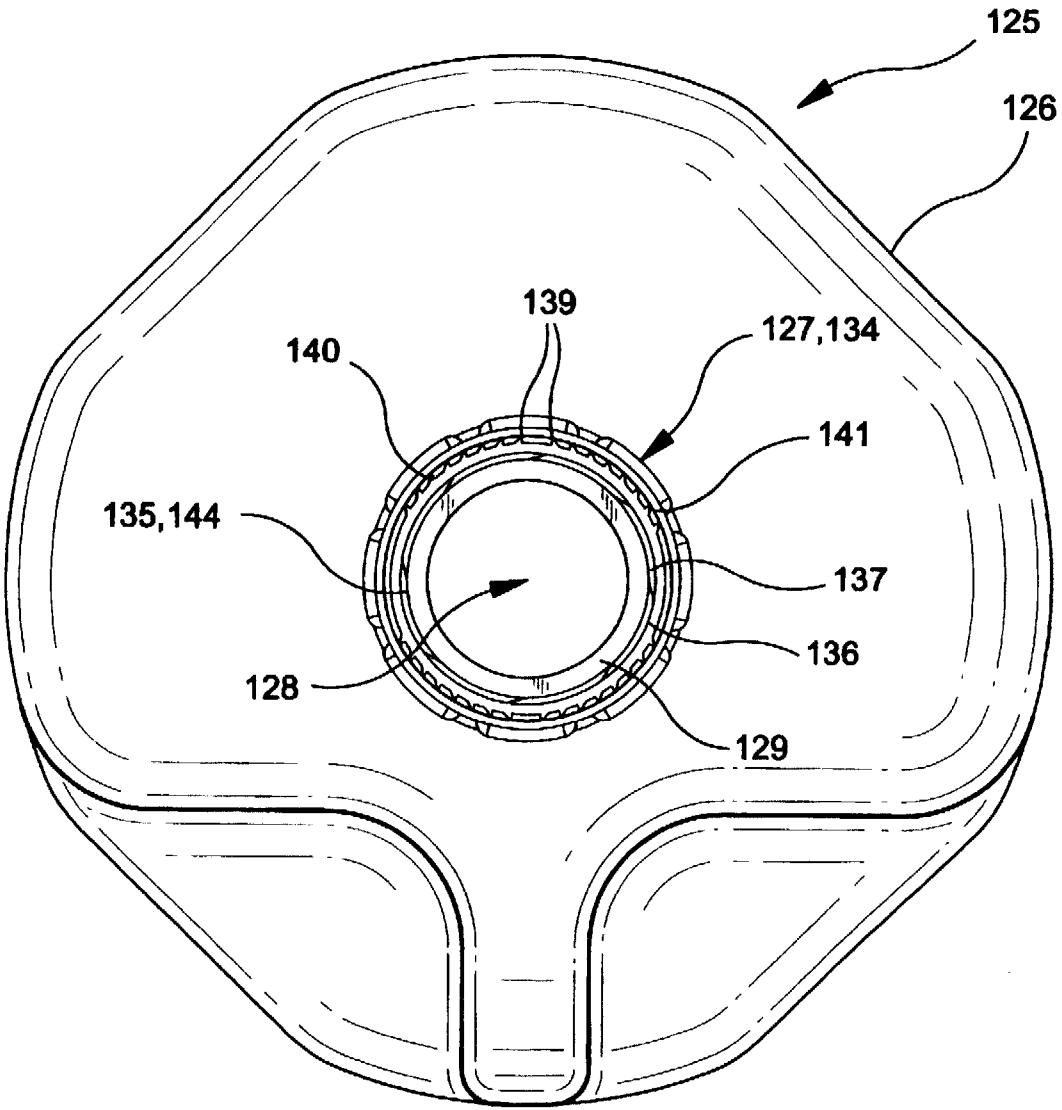
FIG. 8 is an top view of the container of FIG. 1.

To remove the tamper-evident ring 106*a*, the free end of the pull tab 122*a* is urged away from the lower skirt to tear the frangible membrane 132. Applying further force to the pull tab allows the lower skirt 106*a* to tear along the frangible line of weakness or bridges coupling the lower skirt to the upper skirt until the lower skirt is completely removed from the cap. In the embodiment shown in FIG. 12, three pull tabs are symmetrically positioned around the lower skirt to provide at least one pull tab convenient to the user regardless of the orientation of the cap to the bottle. The novel lower skirt, membrane and pull tab arrangement allows the lower skirt to be removed in one continuous strip whereby the membranes remaining intact hold the lower skirt sections together upon removal from the upper skirt. More specifically, the membranes which remain intact are stronger than the line of weakness or bridges coupling the lower skirt to the upper skirt so that the lower skirt separates from the upper skirt as a single unit. Furthermore, the sectioned lower skirt, i.e., the slot between the sections, provides a starting point for removal of the tamper-evident lower skirt from the cap. Naturally, the sectioned tamper-evident skirt may be constructed having as many or as few pull tabs as desired. Additionally, as will be appreciated by those of ordinary skill in the art, the tamper-evident ring of the present invention may be used in conjunction with many known cap designs and neck finishes. Finally, the frangible membranes 132 may be replaced by the more conventional ties between the pull tabs and lower skirt, as shown in FIGS. 5 and 6, provided such ties are strong enough to allow separation of the lower skirt from the upper skirt as a single unit.

Those skilled in the art will recognize that there are many variations of the invention that are within the scope of the invention, therefore, the invention is to be defined only by the limitations and the equivalents thereof which the following claims set forth.

What is claimed is:

1. In combination, a container neck and a container cap, said container neck having an upper opening, a first threaded neck portion depending downwardly from said upper opening and having at least one external thread, and a second neck portion depending downwardly from said threaded neck portion, said second neck portion including external anti-rotation means; and said container cap having a top surface, an upper skirt portion depending downwardly from said top surface, said upper skirt portion having at least one internal thread, and a tamper indicating ring depending downwardly from said upper skirt and integrally connected thereto via a frangible line of weakness, said tamper indicating ring including internal anti-rotation means, said tamper indicating ring having at least two sections separated by at least two slots, said tamper indicating ring including at least two pull tabs, each pull tab having a first end connected to an outer surface of the section of the tamper indicating ring adjacent one of said slots and a free end extending over said adjacent slot and a plurality of frangible membranes extending, respectively, between the outer surface of the tamper indicating ring sections and the free end of each pull tab, wherein pulling on one of said pull tabs breaks the frangible membrane exposing one of said at least two slots followed by removal of the tamper indicating ring from the upper skirt by breaking along the line of weakness while the remaining membrane stays intact and the frangible ring is completely removed from the upper skirt as a single unit.

2. The combination of claim 1, wherein each of the frangible membranes couples the at least two sections of said tamper indicating ring.

3. The combination of claim 1, wherein the anti-rotation means on the cap and container prevents both clockwise and counter-clockwise rotation of said cap relative to the container neck.

4. The combination of claim 1, wherein the tamper evident ring includes at least three symmetrical sections separated by three slots and a pull tab associated with each section, the three pull tabs being symmetrically disposed around said tamper evident ring.

5. The combination of claim 1, wherein the cap and neck threads include eight thread leads and are of a modified buttress construction.

6. The combination of claim 1, wherein the container includes a parting line and the threads on the neck of the container are interrupted and do not traverse the parting line.

7. The combination of claim 1, further including an annular sealing ring located on the first threaded neck portion below the at least one thread.

8. In combination, a container having an opening and a neck depending downwardly from the opening, and a cap, the cap comprising a top surface, an upper skirt depending downwardly from said top surface, and a tamper-indicating lower skirt depending downwardly from the upper skirt, the lower skirt being frangibly connected to the upper skirt along a line of weakness;

the container neck and cap including cooperative threads for removal and replacement engagement therebetween, the container and lower skirt of the cap including interengaging abutment members for preventing removal of said cap unless said upper and lower skirts are disconnected at said line of weakness;

wherein the lower skirt includes at least three sections separated by three slots and a pull tab associated with each section substantially symmetrically disposed thereabout adjacent one of said slots, each of said pull tabs including a first end connected to an outer surface of the associated lower skirt section and a free end extending over said slot, and a frangible membrane extending between the outer surface of the lower skirt and the free end of the associated pull tab, wherein upon pulling on any pull tab, the associated frangible membrane is first broken exposing one of said slots followed by removal of the tamper-indicating ring from the upper skirt by breaking along the line of weakness while the remaining frangible membranes remain intact and the lower skirt is completely removed from the upper skirt as a single unit.

9. The combination of claim 8, wherein the frangible membrane extends across said slot coupling two sections of the lower skirt.

10. The combination of claim 8, wherein the interengaging abutment members prevent both clockwise and counter-clockwise rotation.

11. The combination of claim 10, wherein the abutment member of the cap comprises a plurality of lugs, the upper portions of each lug forming the frangible line of weakness coupling the lower skirt to the upper skirt.

12. The combination of claim 8, wherein the abutment member of the cap comprises at least one lug, the lug having parallel opposed side walls which taper downwardly to a point.

13. The combination of claim 8, wherein the container and cap each include an eight lead thread.

14. The combination of claim 13, wherein each of the threads is a modified buttress thread.

15. The combination of claim 8, wherein each of said eight thread leads is approximately 180 angular degrees in length.

16. The combination of claim 8, wherein each of said pull tabs are oriented in the same direction.

17. The combination of claim 8, wherein the container includes a parting line and the threads on the neck of the container are interrupted and do not traverse the parting line.

18. The combination of claim 8, further including an annular sealing ring located below the threads on the neck of the container.

19. A container closure for use with a container neck of the type having an opening, a first threaded neck portion depending downwardly from said opening, and a second neck portion depending downwardly from said threaded neck portion, said second neck portion including at least one abutment member, said closure having a top surface and upper skirt depending downwardly from said top surface, said closure further including an annular valve depending downwardly from the top surface of said cap, the valve providing a seal with a container opening when said closure is affixed to a container neck, and a tamper evident lower skirt depending downwardly from said upper skirt along a frangible line of weakness, the lower skirt including at least one abutment member for engagement with the at least one abutment member on the container neck to prevent rotation of the cap relative to the container, the lower skirt being constructed of at least two sections separated by slots, each section having associated therewith a pull tab, the pull tab having a first end coupled to an outer surface of said lower skirt section and a free end extending over said adjacent slot, and a frangible membrane associated with each pull tab, the membrane being connected to an outer surface of the lower skirt and the free end of the pull tab, wherein upon pulling on any pull tab, the associated frangible membrane is first broken exposing one of said slots followed by removal of the lower skirt from the upper skirt by breaking along the line of weakness while the remaining frangible membrane remains intact and the lower skirt is completely removed from the upper skirt in a single piece.

20. The container closure of claim 19, wherein the membrane extends across the slot thereby coupling the at least two sections of the lower skirt.

21. The container closures of claim 19, wherein the membrane is stronger than said frangible line of weakness.

* * * * *